US007070727B2

(12) United States Patent
Calhoun et al.

(10) Patent No.: US 7,070,727 B2
(45) Date of Patent: Jul. 4, 2006

(54) METHODS FOR MAKING MICROSTRUCTURED POLYMER SUBSTRATES

(75) Inventors: Clyde D. Calhoun, Grant Township, MN (US); David C. Koskenmaki, St. Paul, MN (US); James G. Berg, Lino Lakes, MN (US); Jennifer M. Aamodt, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 57 days.

(21) Appl. No.: 10/600,966

(22) Filed: Jun. 20, 2003

(65) Prior Publication Data

US 2004/0005434 A1 Jan. 8, 2004

Related U.S. Application Data

(62) Division of application No. 08/902,172, filed on Jul. 29, 1997, now Pat. No. 6,605,332.

(51) Int. Cl.
*B29C 41/00* (2006.01)
*B28B 11/08* (2006.01)
*B29D 7/00* (2006.01)

(52) U.S. Cl. ..... 264/293; 264/299; 264/300; 264/313; 264/316; 264/319; 264/336; 264/167

(58) Field of Classification Search ..... 264/299, 264/300, 313, 316, 334, 336, 319, 293, 167
See application file for complete search history.

(56) References Cited

U.S. PATENT DOCUMENTS 3,027,595 A 4/1962 Takai et al.
3,041,193 A 6/1962 Hamway et al.
3,055,357 A 9/1962 Redka
3,142,599 A 7/1964 Chavannes
3,152,002 A 10/1964 Wisotzky et al.
3,179,550 A 4/1965 Friedman
3,192,589 A 7/1965 Pearson
3,266,113 A 8/1966 Flanagan, Jr.
3,284,274 A 11/1966 Hulslander et al.
3,312,583 A 4/1967 Rochlis
3,312,586 A 4/1967 Barlow
3,325,845 A 6/1967 Sawkiw
3,524,791 A 8/1970 Bethman et al.
3,600,260 A * 8/1971 Watanabe ..... 428/85

(Continued)

FOREIGN PATENT DOCUMENTS

DE 1964736 7/1970

(Continued)

OTHER PUBLICATIONS

Fairchild's Dictionary of Textiles, 7th ed., definition of FIBER, p. 214, 1996.

*Primary Examiner*—Cheryl A. Juska
(74) *Attorney, Agent, or Firm*—Jean A. Lown; James D. Withers

(57) ABSTRACT

A unitary polymer substrate having a plurality of microfibers projecting from a surface is provided. The presence of the microfibers greatly increases the surface area and can impart a cloth-like feel to the surface. The projecting microfibers may have a variety of forms, including frayed-end microfibers, tapered microfibers, microfibers having an expanded cross-sectional shape, and microfibers having a very high aspect ratio. A number of methods of producing unitary polymer structures with a plurality of projecting microfibers are also provided.

24 Claims, 17 Drawing Sheets

U.S. PATENT DOCUMENTS

| | | | | |
|---|---|---|---|---|
| 3,607,493 | A | | 9/1971 | Anderson |
| 3,693,851 | A | | 9/1972 | Yazawa |
| 3,709,752 | A | | 1/1973 | Wistozky et al. |
| 3,772,224 | A | | 11/1973 | Marlin et al. |
| 3,814,644 | A | | 6/1974 | Anderson |
| 3,849,156 | A | | 11/1974 | Marlin et al. |
| 3,870,778 | A | | 3/1975 | Steel |
| 3,950,582 | A | | 4/1976 | Keuchel |
| 3,973,059 | A | | 8/1976 | Brown et al. |
| 3,976,820 | A | * | 8/1976 | Giovanelli et al. ..... 428/85 |
| 3,979,532 | A | | 9/1976 | Muck et al. |
| 4,025,678 | A | | 5/1977 | Frank |
| 4,048,269 | A | | 9/1977 | Wisotzky et al. |
| 4,056,593 | A | | 11/1977 | de Navas Albareda |
| 4,076,874 | A | | 2/1978 | Giovanelli et al. |
| 4,180,606 | A | | 12/1979 | Hance et al. |
| 4,183,889 | A | | 1/1980 | Brendel |
| 4,186,239 | A | | 1/1980 | Mize et al. |
| 4,189,336 | A | | 2/1980 | Hutflesz |
| 4,259,393 | A | | 3/1981 | Marco |
| 4,316,928 | A | | 2/1982 | Otto |
| 4,318,949 | A | | 3/1982 | Okamoto et al. |
| 4,331,724 | A | | 5/1982 | Su |
| 4,376,147 | A | | 3/1983 | Byrne et al. |
| 4,422,837 | A | | 12/1983 | Rasmussen |
| 4,436,520 | A | | 3/1984 | Lipko et al. |
| 4,440,709 | A | | 4/1984 | Rasmussen |
| 4,451,419 | A | * | 5/1984 | Bye et al. ..... 264/164 |
| 4,546,029 | A | | 10/1985 | Cancio et al. |
| 4,612,229 | A | | 9/1986 | Vittone et al. |
| 4,636,417 | A | | 1/1987 | Rasmussen |
| 4,778,634 | A | | 10/1988 | Douglas |
| 4,815,714 | A | | 3/1989 | Douglas |
| 4,832,886 | A | | 5/1989 | Douglas |
| 5,032,122 | A | | 7/1991 | Noel et al. |
| 5,097,570 | A | | 3/1992 | Gershenson |
| 5,116,563 | A | | 5/1992 | Thomas et al. |
| 5,230,851 | A | | 7/1993 | Thomas |
| 5,273,805 | A | | 12/1993 | Calhoun et al. |
| 5,318,741 | A | | 6/1994 | Thomas |
| 5,326,415 | A | | 7/1994 | Thomas et al. |
| 5,403,478 | A | | 4/1995 | Brinkley |
| 5,403,884 | A | | 4/1995 | Perlinski |
| 5,407,735 | A | | 4/1995 | Fukuda et al. |
| 5,416,958 | A | | 5/1995 | Lilly et al. |
| 5,462,765 | A | | 10/1995 | Calhoun et al. |

FOREIGN PATENT DOCUMENTS

| | | |
|---|---|---|
| EP | 0334574 | 9/1989 |
| FR | 2030102 | 10/1970 |
| GB | 1169621 | 11/1969 |
| GB | 1208056 | 10/1970 |
| GB | 1491901 | 11/1977 |
| GB | 2216556 | 10/1989 |
| JP | 57-25926 | 2/1982 |
| WO | WO 94/23610 | 10/1994 |

* cited by examiner

METHODS FOR MAKING MICROSTRUCTURED POLYMER SUBSTRATES

CROSS REFERENCE TO RELATED APPLICATIONS

This application is a division of U.S. patent application Ser. No. 08/902,172, filed Jul. 29, 1997, now U.S. Pat. No. 6,605,332.

BACKGROUND OF THE INVENTION

Polymer substrates with a large number of microfibers on a surface have a wide variety of potential applications. Such microstructured polymer films may be applied to a surface in order to decrease the gloss of the surface. Other surfaces which may benefit from the application of materials having increased surface area due to the presence of a large number of microfibers include carrier webs for use with adhesive tapes. Polymer surfaces covered with a plurality of microfibers also typically have a soft or cloth-like feel and can provide a low friction surface. Polymer sheet materials with smooth planar surfaces are often treated to provide fibers or fiberlike features protruding from at least one major surface. Alteration of a surface in this manner can produce a number of effects, e.g., a decorative appearance, the dispersion of incident light, increased wicking of fluids and/or a low friction surface.

A variety of methods for producing polymer films having a surface with a suede-like feel are known. For example, one of the oldest methods of achieving this effect is called flocking. This involves attaching one end of chopped fibers to a planar surface. Various methods have been used to position the fibers perpendicular to the planar surface (e.g., U.S. Pat. No. 3,973,059 or U.S. Pat. No. 5,403,884). Woven textiles are often passed through a napping machine which pulls loops of small strands from the woven article. The small pulled fibers may break or simply form a loop. The overall napping process typically imparts a soft feel to the napped surface of the article. Another approach which has been used to alter the surface of materials such as leather is to abrade the surface with abrasives such as sand paper. Processes of this type are used to make suede leather. A suede-like feel has been imparted to the surface of polymer foam materials by heat skiving the surface so that the thin sidewalls of the ruptured foam cells provide a soft feel to the treated surface (see, e.g., U.S. Pat. Nos. 3,814,644 and 3,607,493). Yet another method, such as disclosed in U.S. Pat. No. 5,403,478, involves bonding a non-woven sheet onto a plastic film. A suede-like feel has also been achieved by the extrusion of fibers onto a thermoplastic polymer film and heat bonding the fibers to the film (see, e.g., U.S. Pat. Nos. 3,152,002, 4,025,678 and 5,403,884).

Several patents (e.g. U.S. Pat. Nos. 5,116,563; 5,230,851; and 5,326,415) disclose a substrate having a plurality of tapered prongs on a surface. The prongs are formed by depositing islands of heated, thermally sensitive material (e.g., a thermoplastic material) onto the moving substrate surface such that a velocity differential exists between the depositing thermally sensitive material and the underlying substrate surface. The tapered prongs typically have a base diameter of about 700–1300 microns and heights of about 500–2000 microns. Other methods of forming tapered thermoplastic projections on an underlying sheet have also been reported. U.S. Pat. No. 3,027,595 discloses the formation of an artificial velvet fabric having a plurality of pile-like projections. The projections are formed by contacting a thermoplastic sheet with the heated surface of a drum having a multiplicity of closely spaced conical depressions in its surface. The exemplary pile-like projections disclosed have a base diameter of about 150 microns and a length of about 3000 microns (3 mm). U.S. Pat. No. 5,407,735 discloses a napped polyester fabric having sheath-core polyester fibers with a tapered tip. The fibers typically have a fineness in the range of 2 to 6 deniers and pile lengths of about 3 mm.

In order for the articles containing microstructured polymer materials to realize their full potential, versatile, inexpensive methods of fabricating such polymer materials must be available. Current methods typically only permit the generation of polymer substrates with limited types of microstructure configurations. A need, therefore, continues to exist for improved methods of producing polymer substrates having a surface with a napped texture. Such methods would preferably permit the production of polymer substrates with a defined microscopic pattern. Optimally, the method would also permit the introduction of macroscopic structural features (e.g., via embossing) and/or would allow the choice of generating a microscopic pattern on either all or a portion of the surface.

SUMMARY OF THE INVENTION

The application provides a polymer substrate having a plurality of microfibers projecting from at least one major surface. The microfibers are integral with and have the same composition as the underlying substrate, i.e., the microfibers and the underlying substrate form a unitary construction. The microfibers extend from the underlying major substrate and may have a variety of shapes. For example, the microfibers may have any of a number of cross-sectional shapes including squares, triangles, circles, ovals, rectangles or other geometric shapes as well as more irregular shapes. The placement of the microfibers on the surface may be random or in a predetermined array.

In one embodiment, a unitary polymer substrate which includes a plurality of frayed-end microfibers is provided. The microfibers themselves can include one or more surfaces having a plurality of microfibrils, i.e., microfibers of even smaller dimensions protruding from a surface of the larger microfibers. The microfibrils also typically have frayed ends. Unitary polymer films with a plurality of frayed-end microfibers typically have an extremely high surface area (e.g., as measured by nitrogen adsorption and/or electron microscopy).

A unitary polymer substrate having a napped surface which includes a plurality of microfibers having an expanded cross-section shape is also provided. The expanded cross-section shaped microfibers typically have an average maximum cross-sectional dimension of no more than about 200 microns and, preferably no more than about 100 microns. As used herein, "expanded-cross section shape" is defined as a shape having a cross-sectional surface area which increases and then decreases along a perpendicular vector away from the surface of the unitary polymer substrate thereby creating a bulge in the microfiber. The cross-sectional surface area is measured in a plane parallel to the major surface of the polymer substrate from which the microfiber extends. The bulge may be the tip end ("expanded-head shape") and/or in the middle of the microfiber. Microfibers of this type may have more than one expanded cross-sectional portion ("bulge") along their length, e.g., microfibers generated using an open cell foam as a template surface.

Another polymer substrate with a napped surface is described herein. The substrate is a unitary polymer substrate which includes a plurality of tapered microfibers projecting from the surface. Such tapered micofibers typically have an average maximum base cross sectional dimension of no more than about 200 microns and an average maximum half height cross sectional dimension of no more than about 100 microns. The average height of the tapered micofibers is typically at least about 400 microns and preferably about 500 to about 2,000 microns.

The present napped polymer surfaces may be prepared by a number of different methods. One method includes contacting a surface of a polymer substrate with an abrasive surface in a reciprocating manner to form a napped polymer surface including a plurality of frayed-end microfibers.

Polymer surfaces having a plurality of projecting expanded cross-section shaped microfibers may be produced by a method which includes laminating a polymer substrate to a resilient template surface having a plurality of microdepressions. During the lamination process softened material from the surface of the polymer substrate is forced into the microdepressions thereby forming a plurality of microprojections extending from the substrate surface. If the surface of the polymer substrate is maintained in a sufficiently softened state while it is delaminated from the template surface, the microprojections can be stretched such that a plurality of microfibers extending from the polymer surface are generated prior to the debonding of the polymer substrate surface from the template surface. In other words, a blob of the softened polymer remains entrapped in the microdepression for a period of time while a stem of polymer connecting the blob to the underlying surface is drawn out. The stem increases in length while the polymer surface is cooling until the point where the blob of polymer is pulled out of the microdepression.

Another method of producing unitary polymer substrates having a plurality of microfibers includes laminating two thermoplastic polymer substrates (e.g., films) to opposite sides of a template film having a plurality of microscopic holes therethrough. The template film is typically either coated with or formed from a release material such as a silicone release material. The thermoplastic polymer substrates are laminated to the template film so that a plurality of microprotrusions project from each of the thermoplastic polymer substrates into the holes and bond the two polymer substrates together through the tips of the microprotrusions. The thermoplastic polymer substrates are then delaminated from the template film while maintaining the thermoplastic polymer substrates in a sufficiently softened state to stretch the microprotrusions into microfibers prior to debonding of the thermoplastic polymer substrates from each other. Microfibers formed via this method typically have a tapered profile.

Another method which may be used to produce a unitary polymer film includes laminating a carrier film to a non-porous thermoplastic polymer film. The carrier film is then pulled away from the polymer film while maintaining the thermoplastic polymer in a sufficiently softened state to allow a portion of the polymer film to be pulled and stretched into a plurality of high aspect ratio microfibers (e.g., microfibers that resemble an extremely thin "angel hair pasta"). The high aspect ratio microfibers extend from and are integral with the thermoplastic polymer surface. Napped polymer surfaces of this type are characterized by substantially all of the microfibers (i) having a tip end and (ii) being integrally connected to the underlying polymer surface at their base. As used herein, "tip end" means that portion of the microfiber which is furthest from the base along a path that starts at the base and runs length-wise along the fiber. The microfibers generated by this method typically have an aspect ratio of at least about 10 and preferably at least about 20, however, microfibers having an aspect ratio greater than 100 can generated by this method.

DETAILED DESCRIPTION OF THE INVENTION

Figure 1:
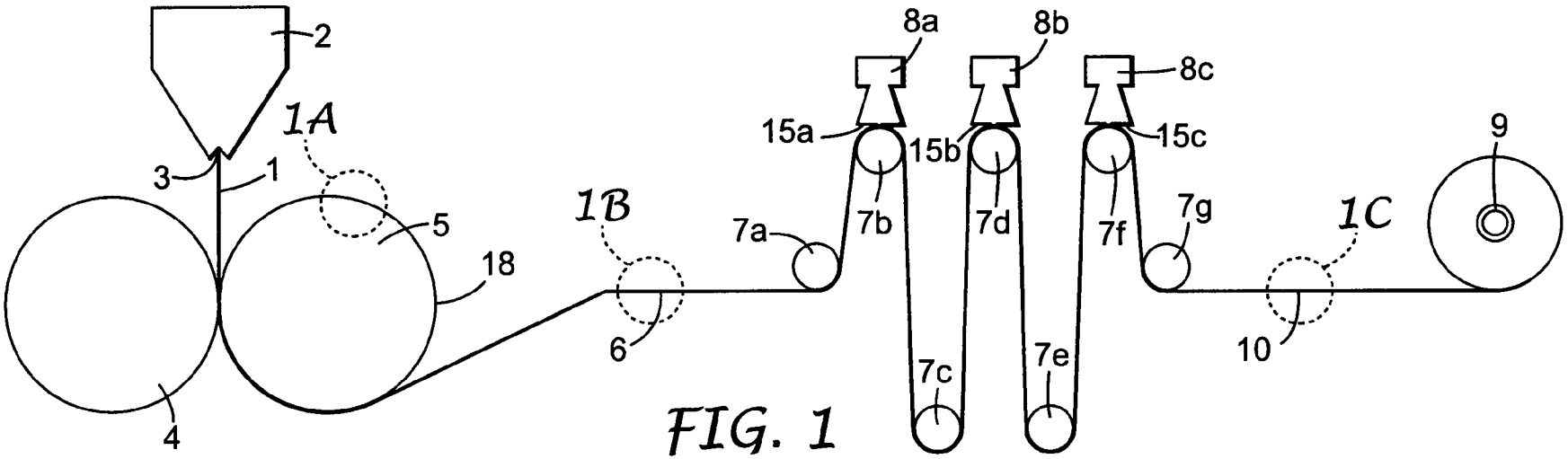
FIG. 1 depicts a simplified schematic illustration of one embodiment of a method for producing a napped polymer film according to the present invention.
Figure 1C:
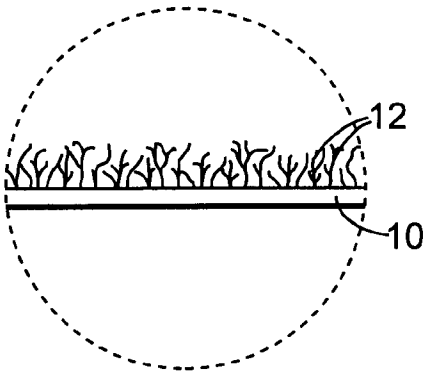
FIG. 1C depicts microfibers.

The unitary polymer substrates provided herein have a plurality of microfibers projecting from a major surface. The microfibers have the same composition as the underlying substrate surface and form a unitary construction. Although not a requirement, the major axis of the microfibers typically is substantially perpendicular to the underlying major substrate surface. The microfibers may have any of a number of cross-sectional shapes including squares, circles, ovals, rectangles, other geometric shapes or more irregular shapes. The profiles of the microfibers may also vary greatly. As used herein "profile" refers to the cross sectional projection of a microfiber viewed in a plane perpendicular to the major surface of the underlying polymer substrate. For example, the polymer substrates provided herein may include expanded-cross section shaped microfibers (e.g., expanded head shapes where the head has a partially spherical configuration), frayed end microfibers, tapered microfibers and/or microfibers having a very high aspect ratio.

In addition, the cross sectional area of the microfibers may be substantially constant, may be tapered or may vary as some irregular function (e.g., include "bulge(s)" at the tips and/or along the length of the microfibers). As used herein, a "tapered" microfiber is a microfiber whose cross-sectional area decreases in a continuous fashion along a path along the fiber leading away from the surface of the underlying polymer substrate.

The placement of the microfibers on the surface may be random or based on some predetermined array. For example, if the microfibers are generated using a template structure such as a screen formed from a resilient release material, a regular array of microfibers reflecting the spacing of the holes in the template structure may be generated. Alternately, the placement of the microfibers may be completely random as is the case for napped polymer surfaces such as those generated by pulling a thermoplastic polymer film apart while the film is in a softened state. This generates a unitary polymer film having a plurality of randomly oriented, high aspect ratio microfibers extending from a surface of the film ("angel hair microfibers").

A wide variety of polymers may be processed according to the present methods into a polymer substrate having a microstructured surface. Polymer materials capable of being sufficiently flowable to allow the polymer to conform to the microscopic features of a resilient surface and/or capable of being solidified sufficiently to generate microscopic features on the polymer surface are suitable for use in the present invention. Typically, the polymer material includes a thermoplastic polymer such as a polyolefin, although other polymer materials capable of being processed in a flowable state may also be employed.

The polymer material generally includes a thermoplastic polymer having a melt temperature above about 50° C. However, polymer materials which exist in a flowable state at a considerably higher temperature may also be employed. Where the napped polymer surface is formed by a process which includes separation of the napped surface from a resilient template surface, the physical properties of the resilient surface and the polymer material must be matched such that the microstructural features of the resilient surface are stable and resilient under conditions which permit the thermoplastic polymer to conform to a template surface and then at least partially solidify. Preferably, thermoplastic materials which can be passed through an embossing nip at or slightly above their glass transition temperature are employed, as such materials may be processed with short cycle times.

Examples of suitable thermoplastic polymer materials which may be employed in the present process include polyolefins such as polypropylene, polyethylene, and polypropylene/polyethylene copolymers. Blends of polypropylene and/or polyethylene, such as a high/low molecular weight polyethylene blend (e.g., Hostalloy™ 731; Hoechst Celanese, Somerville, N.J.), are also suitable for use in the present invention. Other suitable thermoplastic polymers include polyvinyl chloride (PVC), polyamides such as nylon (e.g., nylon 6, nylon 6,6, or nylon 6,9), and polyesters. Olefin copolymers such as ethylene/vinyl acetate copolymers or copolymers of an olefin and an $\alpha,\beta$-unsaturated acid (e.g., an ethylene/methacrylic acid copolymer reacted with metal salts to confer ionic character; available from E.I. du Pont de Nemours & Co., Inc. as SURLYN 8527) may also be employed in the present invention. Preferably, the polymer material includes a polyolefin or an olefin copolymer.

The napped polymer surfaces provided herein may be generated via a variety of methods. For instance, a unitary napped polymer substrate may be produced by reciprocatingly contacting a surface of a thermoplastic polymer substrate with an abrasive surface to form a plurality of frayed-end microfibers projecting from the thermoplastic polymer surface. It has been found that contacting the abrasive surface in a reciprocating manner is a far more effective method of generating frayed-end microfibers than if the abrasive is contacted with the polymer substrate continuously in a single direction (e.g., passing the substrate surface over a rotating roll covered with an abrasive surface).

Figure 1B:
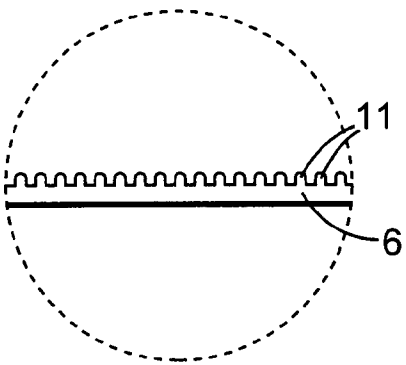
FIG. 1B depicts protrusions on the film.
Figure 1A:
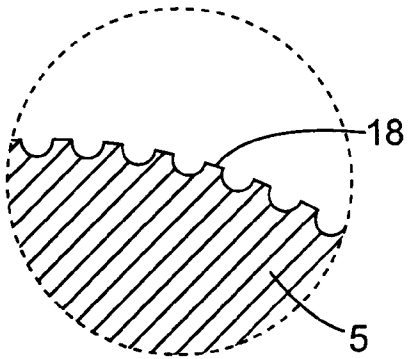
FIG. 1A depicts a cross sectional view of a portion of the surface 18 of the structured roll 5 shown in FIG. 1.

FIG. 1 depicts a schematic illustration of one embodiment of a method of producing a unitary napped substrate having a plurality of frayed-end microfibers. A flowable polymer material 1 is brought into contact with the surface 18 of a structured roll 5. The polymer material 1 is in a flowable state as it enters the nip between heated roll 4 and structured roll 5, e.g., after exiting the die 3 of an extruder. Alternatively, the polymer may be treated just prior to entering the nip, such as by the application of heat, to transform the polymer into a flowable state. During processing, sufficient pressure is exerted in the nip on the flowable material by heated roll 4 and structured roll 5 to force the polymer material to conform to the contours of the structured roll, thereby forcing the flowable polymer into any recesses or crevices defined by microdepressions present in surface 18 (FIG. 1B). This results in the generation of microscopic projections 11 ("microprotrusions") on the polymer surface 6 which had been in contact with structured surface 18. In this method, the structured roll is used to generate microprojections 11 at least about 10 microns high and preferably about 25 to about 100 microns high on the polymer surface 6.

The microstructured polymer film 6 is then brought into contact with a series of abrasion stations 8*a*–8*c* by means of a series of rollers 7*a*–7*g*. The pressure exerted on the polymer film by the abrasion stations is generally such that only the upper portions of the microprotrusions on the polymer film are in contact with the abrasion surfaces (i.e., the land area in between the microprojections is not in contact with the abrasive surfaces). The abrasive surfaces 15*a*–15*c* of abrasion stations 8*a*–8*c* move with some form of reciprocating motion with respect to the forward motion of the passing polymer film. In other words, in contrast to the type of motion observed with a normal nip roll, the abrasion stations move in a back and forth motion with respect to the forward motion of the passing polymer film. The movement may be back and forth along a line which is either parallel or perpendicular to the main direction of movement of the polymer material. Alternatively, the abrasion surfaces 15*a*–15*c* may move in a circular or oval motion with respect to the point of contact. Both of the types of motions include a back and forth component of movement with respect to the point of contact with the passing polymer film and are included within the definition of a reciprocating motion as the term is used herein. It has been found that the use of a reciprocating motion between abrasive and the polymer surface results in very little removal of material from the latter during the formation of the microfibers, i.e., very little swarf (typically no more than about 5 wt. % of the film) is generated by the abrasion of the polymer surface.

It has been found that by contacting an abrasive surface with the microstructured polymer film in this manner, a plurality of microfibers are generated on the surface of the polymer film. The use of a reciprocating motion has been found to be far more effective at generating frayed-end microfibers compared to contacting the polymer material with an abrasive surface moving continuously in single direction (e.g., the surface of an abrasive coated spinning roller). Microfibers generated by this method typically have a frayed-end structure, i.e., the tip end of the microfiber terminates in a number of fibers of smaller dimensions. Such frayed end microfibers typically have an average maximum cross-sectional dimension of at least about 5 microns and, preferably, of about 10 to about 100 microns. More preferably, the microfibers have an average maximum cross-sectional dimension of no more than about 60 microns and an average length of no more than about 500 microns and, most preferably, an average length of about 200 about 300 microns.

The dimensions of the microfibers are a function of the type of polymer material, the type of abrasive present on the abrasive surfaces and the relative speed of the motion of the abrasive surface with respect to the polymer film. The type of abrasive employed will also influence the type and size of microfibers generated. The use of a rougher grit abrasive will generally tend to result in the production of larger microfibers. Abrasive surfaces having a grit of about 40 to about 500 and, preferably, about 80 to about 250 may be used to generate frayed end microfibers of the type described above.

In the example shown in FIG. 1, the polymer film has a plurality of microprotrusions generated on its surface before passing through the abrasive stations. This enhances the rate of formation of the frayed end microfibers on the polymer surface. Frayed end microfibers may also be generated, however, by simply contacting a smooth polymer surface in a reciprocating motion with an abrasive surface. The initial contacts with the abrasive surfaces tend to generate rough microprotrusions in the smooth polymer surface. The rough microprotrusions are then formed into frayed end microfibers by the subsequent reciprocating contact with the abrasive surfaces.

By varying the type of abrasive surface in the abrasive stations, e.g., by employing a coarser grit abrasive on the first abrasive surfaces 15*a*, 15*b* and a finer grit abrasive on the abrasive surface 15*c* a napped polymer surfaces having frayed-end microfibers which include surface(s) with a plurality of microfibrils (i.e., microfibers of even smaller dimensions) can be generated. The microfibrils generated by this process typically also have a frayed-end structure. For example, a napped surface of this type may be produced by initially reciprocatingly contacting a microstructured polymer surface with an abrasive having a grit of about 40 to about 300 and subsequently contacting the surface (now consisting of microfibers) with a finer abrasive having a grit of about 80 to about 500 where the difference in grit between the first and second abrasives is at least about 50. Using this method, microfibrils having average maximum cross-sectional dimension of about 1 to about 5 microns, preferably, no more than about 10 microns, and an average length of no more than about 40 and typically about 10 to about 30 microns can be produced on the surfaces of the relatively larger microfibers having the dimensions described above. The microfibrils typically have dimensions which are a factor of about 5 to about 15 smaller than the dimensions of the microfibers. Whether generated using a singular abrasive surface or with a number or abrasive surfaces of varying coarseness, the napped films generated by this method have an extremely high surface area.

Figure 7:
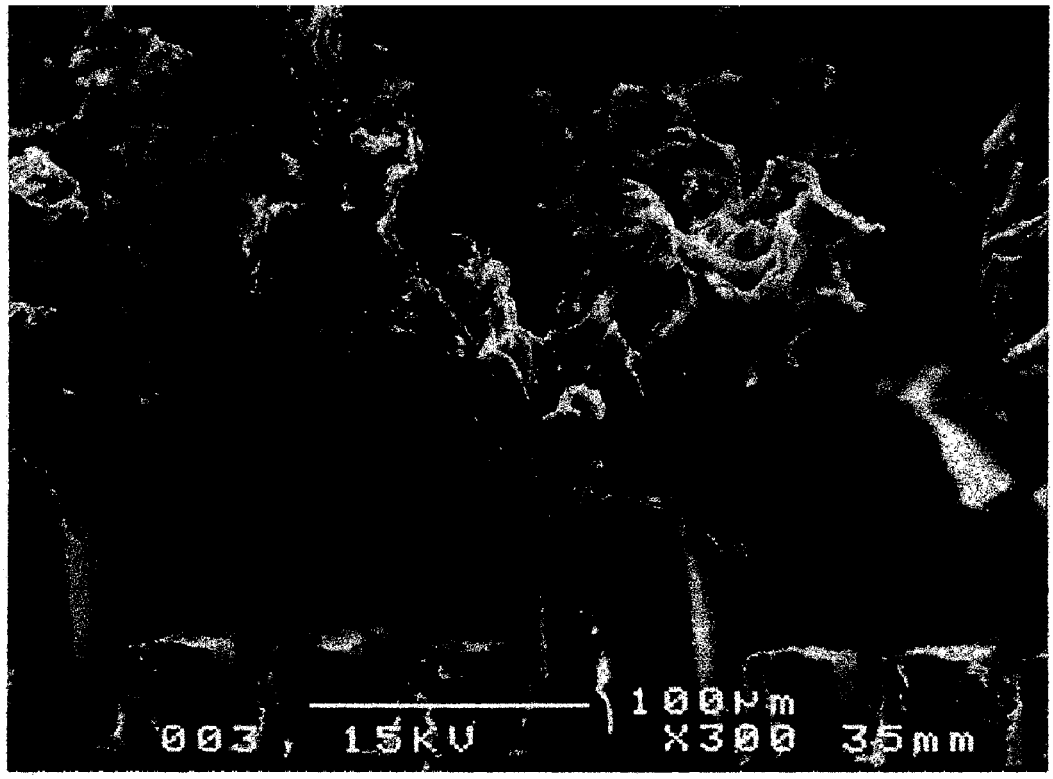
FIG. 7 shows an electron micrograph (300×magnification) of a cross sectional view of a portion of a napped polymer substrate of the present invention.

The present method can be used to produce polymer substrates (e.g., films) having the microfibers only on selected portions of a surface. For example, a film having a plurality of ridges and grooves on a surface may be brought into reciprocating contact with an abrasive surface such that only the top of one or more of the ridges is in contact with the abrasive. Microfibers are then only generated on that portion of the polymer surface in contact with the abrasive surface. A cross sectional view of a section of one such structure generated by this method is shown in FIG. 7.

Figure 16:
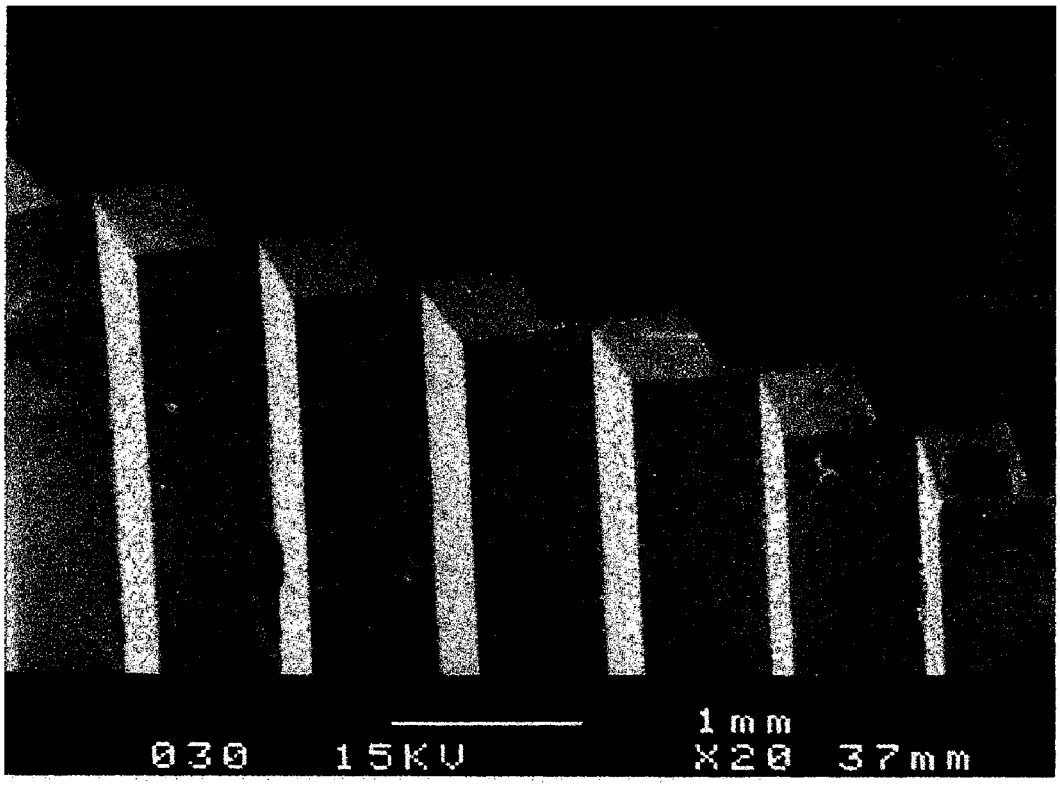
FIG. 16 shows an electron micrograph of a cross section of a grooved polymer substrate prior to treatment according to a method of the present invention.
Figure 17:
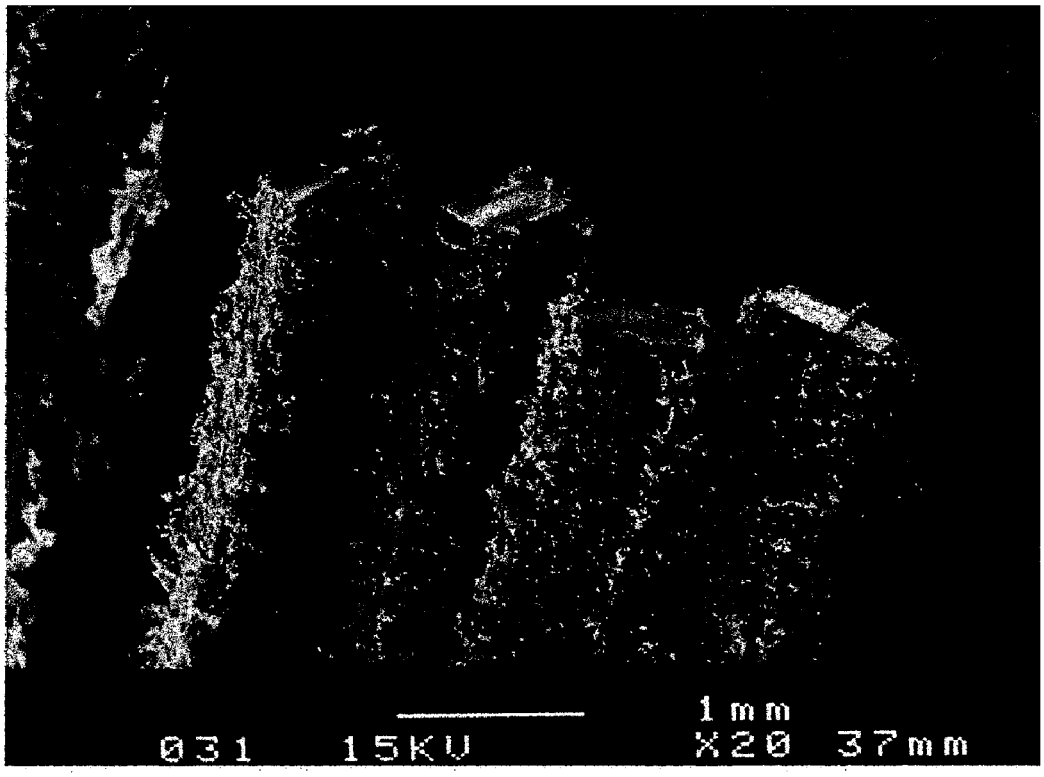
FIG. 17 shows an electron micrograph of a cross sectional view of fibers having a plurality of frayed-end microfibers on their surface, where the fibers were generated by reciprocating contact of the grooved polymer substrate shown in FIG. 16 with an abrasive surface according to a method of the present invention.

One embodiment of this method can be used to produce fibers (e.g., with a diameter of about 0.1 mm to about 1.0 mm) having a plurality of frayed-end microfibers on their surface. For example, as depicted in FIGS. 16 and 17, a 0.45 mm thick sheet of a thermoplastic polymer, such as polyethylene, may be reciprocatingly contacted with an abrasive surface. The thermoplastic film typically has a plurality of closely spaced deep grooves on both sides of the film, e.g., 0.25 mm deep grooves spaced 0.95 mm on center (shown in profile in FIG. 16). In addition to generating frayed-end microfibers on the surface of the thermoplastic polymer, the reciprocating contact with the abrasive surface can cause the film to split apart at the bottom of the grooves to form individual fibers with a plurality of frayed-end microfibers on their surface. Such a process can be used to produce fibers with a diameter of about 0.1 mm to about 1.0 mm having frayed-end microfibers about 50 to about 500 microns in length on the surface thereof.

Polymer surfaces having a plurality of projecting expanded cross-section shaped microfibers may be produced by a method which includes laminating a polymer surface to a resilient template surface having a plurality of undercut-shaped microdepressions. During the lamination process the polymer surface is forced into the microdepressions in the template surface to form a plurality of undercut-shaped microprojections on the polymer surface. If the polymer surface is maintained in a sufficiently softened state while it is delaminated from the template surface, the microprojections can be stretched to form expanded cross-section shaped microfibers on the polymer surface. This may be achieved by cooling the outer surface of the microprojections sufficiently to achieve a non-flowable state while maintaining a portion of the interior of the microprojections in a softened state as the polymer surface is delaminated from the template surface. If the template surface is an open cell foam, microfibers having one or more expanded portions ("bulges") along their length may be formed. Alternately, if a resilient surface with a plurality of partially spherical microdepressions (e.g., microdepressions formed by removing glass beads from a cured silicone rubber film) is employed as the template surface, a napped polymer surface having a plurality of expanded-head shaped microfibers can be generated.

As used herein, the term "undercut-shaped" is defined as a shape having a cross-sectional surface area which increases and then typically decreases along a perpendicular vector away from the polymer surface. In other words, the cross-sectional surface area is measured in a plane parallel to the major surface of the polymer substrate with respect to which the undercut-shaped microdepression or microprotrusion in question is positioned.

The interaction between the forming microfibers, which are at least partially solidified, and the resilient template surface is such that the tip portion of the microfibers, which includes an expanded portion, substantially retain their shape as the microstructured polymer film is pulled away from the resilient template surface. To some extent this may be due to some resiliency on the part of the microprotrusions themselves, as where the solidifying polymer material exhibits some degree of elasticity. More typically, this interaction is achieved by the resiliency of the template surface. The stem portion of the microfibers closer to the underlying polymer surface is typically cooled at a slower rate than the tip portion such that the stem is pulled and/or stretched to form an elongated stem.

As the microprotrusions are pulled out of microdepressions, the temperature of the template surface is typically maintained below the softening point of the polymer material (e.g., where the polymer material is a thermoplastic polymer). Alternatively, where the polymer material has thermoset properties, the solidification may be achieved by applying additional heat to the polymer material while the material is in contact with the template surface.

Expanded cross-section shaped microfibers of the type described above typically have an average maximum cross-sectional dimension of no more than about 200 microns and, preferably of about 25 to about 100 microns. The average height of the expanded cross-section shaped microfibers is generally at least about 1.5 times and preferably about 2 to about 5 times the average depth of the microdepressions in the template surface. For example, expanded cross-section shaped microfibers generated using a closed cell polyurethane foam as a template surface typically have a maximum width of no more than about 200 microns, preferably, no more than about 100 microns. Microfibers of this type typically have an average length of about 50 to about 500 microns.

The material which forms the resilient template surface typically permits the microstructured polymer film to be separated from the resilient template without substantially destroying the microfibers. This requires that the forming napped film does not adhere to the resilient template surface. The resilient template surface may be formed from a number of resilient materials which permit the processed polymer to be removed without problems of adhesion. In a preferred embodiment of the invention, the resilient template surface is formed from a silicone rubber. Resilient template materials formed from a polyurethane or silicone permit the present method to be carried out under a wide range of processing conditions, e.g., temperatures from about 0° C. to about 400° C. or even higher.

The resilient template surface may include a layer of a porous resilient material, such as a polymer foam. Examples of suitable foams for the resilient surface include polyurethane foams and silicone foams. The foam may be a closed cell polyurethane foam such as LS1525 polyurethane foam (available from EAR® Specialty Composites Corporation, Indianapolis, Ind.) or PORON polyurethane foam (available from Rogers Corporation, East Woodstock, Conn.). The closed cell polyurethane foams disclosed in U.S. Pat. Nos. 3,772,224 and 3,849,156, the disclosure of which are herein incorporated by reference, may also be employed as the resilient template surface. Another example of a suitable polymer foam is a closed cell silicone foam such as Bisco BF-1000 foam (available from Bisco Products, Elk Grove, Ill.). The resilient template surface may also be formed from an open cell polymer foam.

The resilient material which forms the resilient template surface may inherently include microdepressions, e.g., the pocket-like depressions present in the surface of a polymer foam. Where the resilient surface includes a polymer foam material, the resilient surface may also include a thin outer layer of a non-porous flexible material covering the foam. For example, the resilient surface may include a foam layer covered by a thin layer (e.g., about 0.5 mm to about 1.0 mm) of silicone rubber. For example, the resilient surface may include Silastic® brand J-RTV silicone rubber (commercially available from Dow Coming Corp., Midland, Mich.).

A desired pattern and/or shape of microprotrusions in a flexible material may also be generated by embedding a plurality of microscopic particles in the surface of a resilient material, such as by embedding inorganic particles (e.g., glass beads) in a silicone rubber layer. For example, microdepressions may be formed in a silicone rubber layer (or other nonporous flexible material) by removing microparticles embedded in the silicone rubber to leave a plurality of microdepressions in the rubber surface. The microdepressions are typically substantially inverted replicas of the microparticles previously embedded in the template surface.

Polymer surfaces having a plurality of projecting tapered microfibers are also provided herein. Such surfaces can be produced by laminating a thermoplastic substrate (e.g., a film) to a template surface having a release surface with a plurality of microdepressions therein. The microdepressions include a non-release surface. In some cases, the entire internal surfaces of the microdepressions may be formed from a non-release material. More typically, however, only the bottom portion of the microdepressions are formed from the non-release material. An example of such a template structure is a polyolefin film (e.g., a polypropylene film) embossed to have a regular pattern of microdepressions and overcoated with a release material such as a silicone release agent. The silicone release agent can be applied to the embossed polyolefin surface so that only the flat land areas and not the internal surfaces within the microdepressions become coated. Lamination of a thermoplastic polymer substrate (e.g., a film) to the template structure can be carried out to form microprojections on the polymer surface, where each microprojection projects into one of the microdepressions and is bonded to the non-release surface therewithin.

Figure 10:
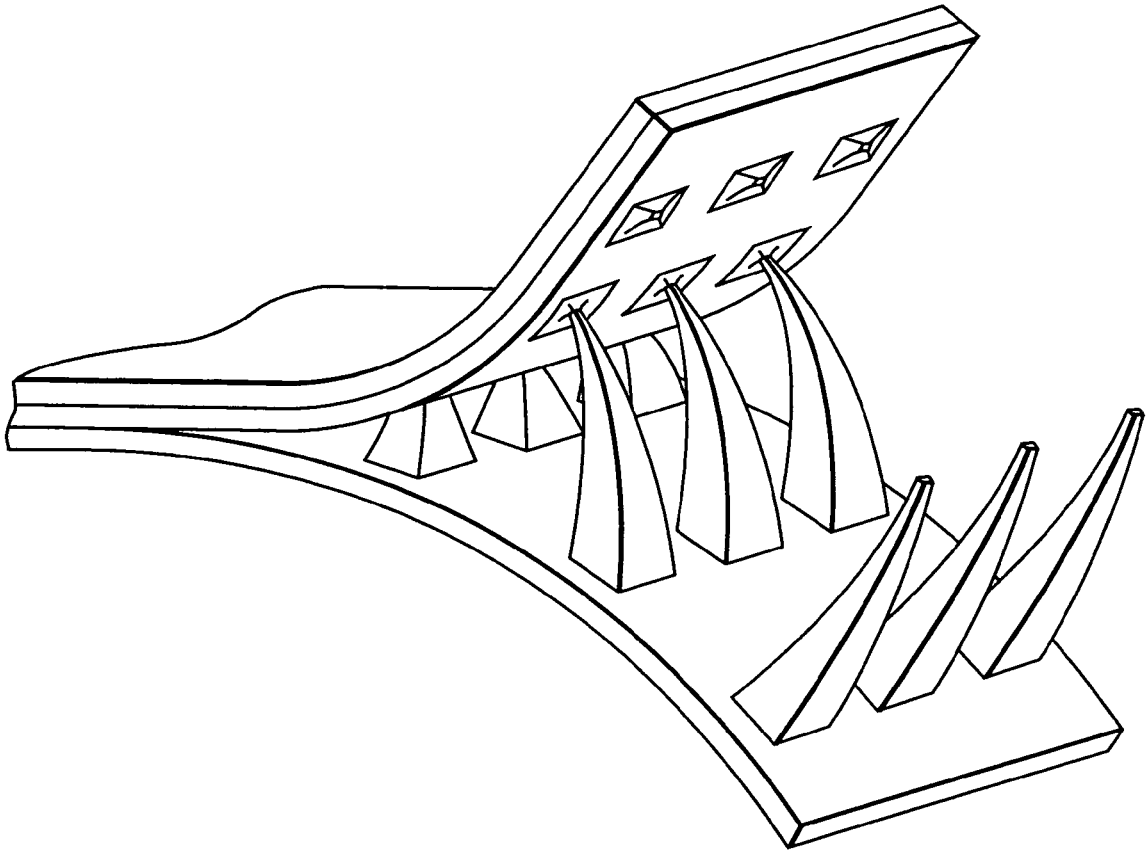
FIG. 10 depicts a simplified schematic illustration of a portion of a napped polymer film being produced by another embodiment of a method of the present invention.

If the thermoplastic material is maintained in a sufficiently softened state during delamination, the thermoplastic microprojections on the polymer substrate can be stretched into microfibers prior to debonding of the thermoplastic polymer substrate from the template surface (see FIG. 10). As depicted in FIG. 10, during the delamination step the polymer material which makes up the microprojections extending into the microdepressions in the template surface may be stretched and drawn out. Thus, the microfibers will typically have an average length that is greater than the average depth of the microdepressions in the template surface. Using such a process, generation of microfibers having an average length that is at least about 2.0 times and preferably about 2.5 to about 10 times the average depth of the microdepressions may be achieved. If the microprojections are drawn out to a sufficient degree during the delamination step, microfibers having a tapered profile can be produced. If the process is carried out in a continuous fashion such as where the template surface is the cover of a nip roll and the polymer substrate is a thermoplastic polymer film passing through the nip, tapered microfibers having a curved profile (see, e.g., the microfibers on the surface shown in FIG. 13) can be generated.

The tapered microfibers generated by the methods described herein can have a variety of cross-sections shapes. Typically, the cross-section of the microdepressions reflects the shape of the microdepressions in the template surface. The cross-sectional area of the base of the microfiber is typically close to but no more than the cross-sectional area of the microdepression (e.g., about 90 to 100% of the cross-sectional area of the microdepression). Since essentially all of the microfiber is derived from the polymer material initially deposited as a microprojection within a microdepression in the template surface, the amount of taper of a microfiber will depend on the extent to which the microfiber is drawn out; the longer the microfibers for a given template surface, the smaller the tip cross-sectional area (and smaller the half-height cross-sectional area) and the higher the total amount of taper of the microfibers.

The tapered microfibers disclosed herein typically have an average maximum base cross-section dimension of at least about 25 microns and generally no more that about 200 microns. The average length of the tapered microfibers is typically no more that about 2,500 microns and preferably about 300 to about 2,000 microns. The amount of taper of the microfibers (two times the ratio of the average base cross-sectional area to the average half-height cross-sectional area) will very as a function of the extent to which the microfibers are drawn out during formation. The tapered microfibers commonly have an amount of taper from end to end of about 10 to 1.

Figure 12:
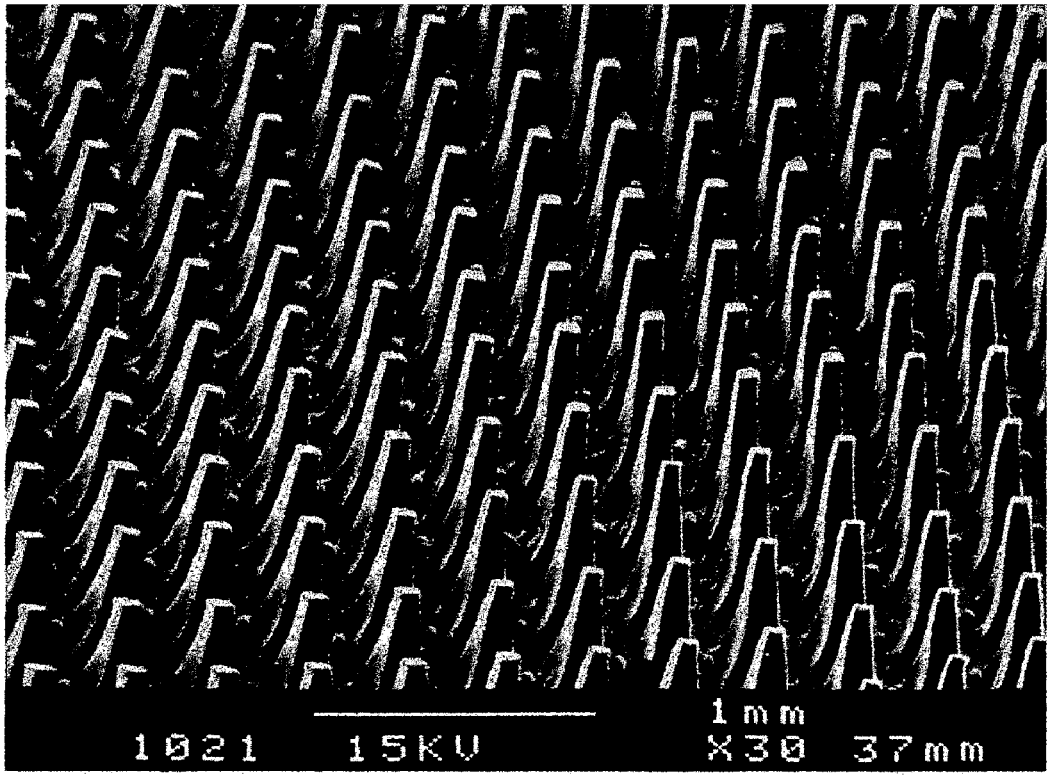
FIG. 12 shows an electron micrograph (30×magnification) of tapered microfibers on a surface of a napped polymer substrate of the present invention.
Figure 13:
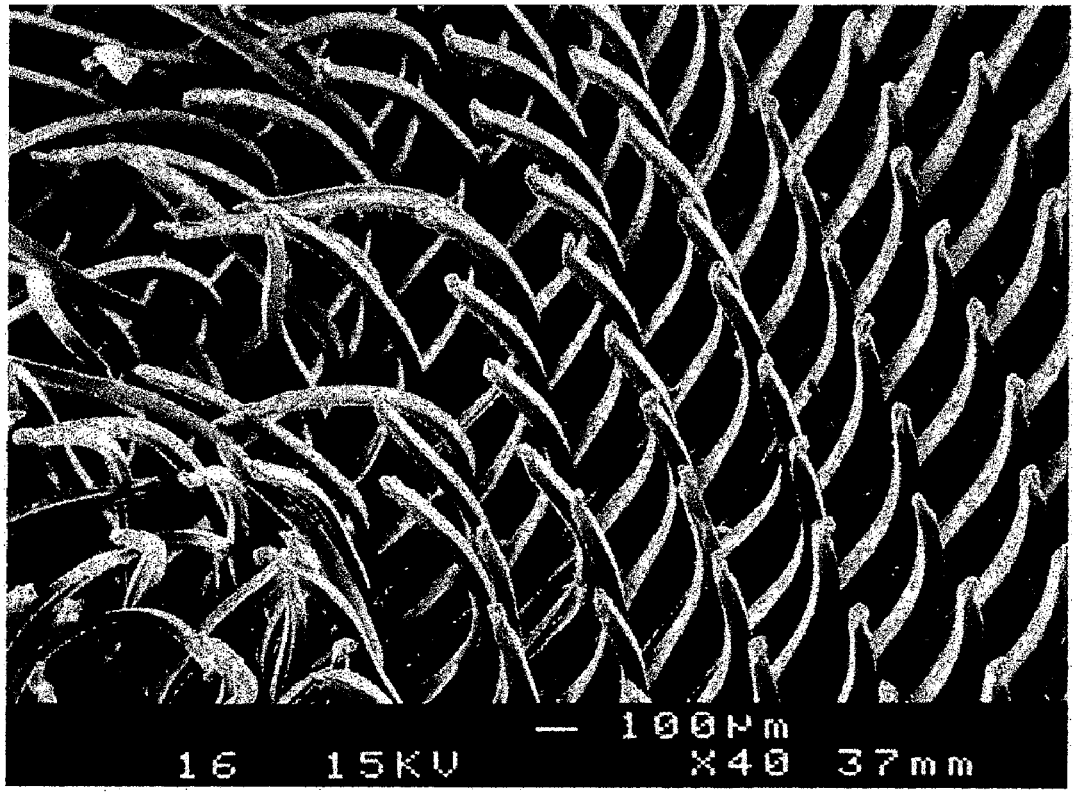
FIG. 13 shows an electron micrograph (40×magnification) of tapered microfibers on a surface of a napped polymer substrate of the present invention.

Another method of producing unitary polymer substrates having a plurality of tapered microfibers includes laminating two thermoplastic polymer substrates (e.g., films) to opposite sides of a template film having a plurality of microscopic holes therethrough. The template film is typically either coated with or formed from a release material such as a silicone rubber. The thermoplastic polymer substrates are laminated to the template film so that a plurality of microprotrusions project from each of the thermoplastic polymer substrates into the holes. During the lamination process, sufficient thermoplastic material is forced into the microscopic holes such that the two polymer substrates are bonded together by the tips of the microprotrusions extending from each of the polymer substrates into the holes in the template film. The thermoplastic polymer substrates are then delaminated from the template film while maintaining the thermoplastic polymer substrates in a sufficiently softened state to stretch the microprotrusions into microfibers prior to debonding of the thermoplastic polymer substrates from each other. The result after delamination is the formation of two unitary polymer napped films in which the microprojections have been stretched into microfibers before the polymer substrates debond from each other. Examples of napped polymer surfaces generated using this method are shown in FIGS. 12 and 13.

Another method which may be used to produce unitary polymer films includes laminating a carrier film to a non-porous thermoplastic polymer film. For example, two unitary polymer films can be produced by a method which includes laminating two carrier films to either side of a non-porous thermoplastic polymer film. The two carrier films are then pulled apart while maintaining the thermoplastic film in a sufficiently softened state to pull and stretch a portion of the thermoplastic polymer film into a plurality of high aspect ratio microfibers (e.g., microfibers that resemble an extremely thin "angel hair pasta", see, e.g., the polymer surface in the electron micrograph shown in FIG. 15) extending from and integral with the portions of the thermoplastic polymer film remaining in contact with the carrier films. Structures having this "angel hair" type structure on a surface may be useful in filter applications due to the ability of such a material to efficiently entrap airborne particulates.

Figure 14:
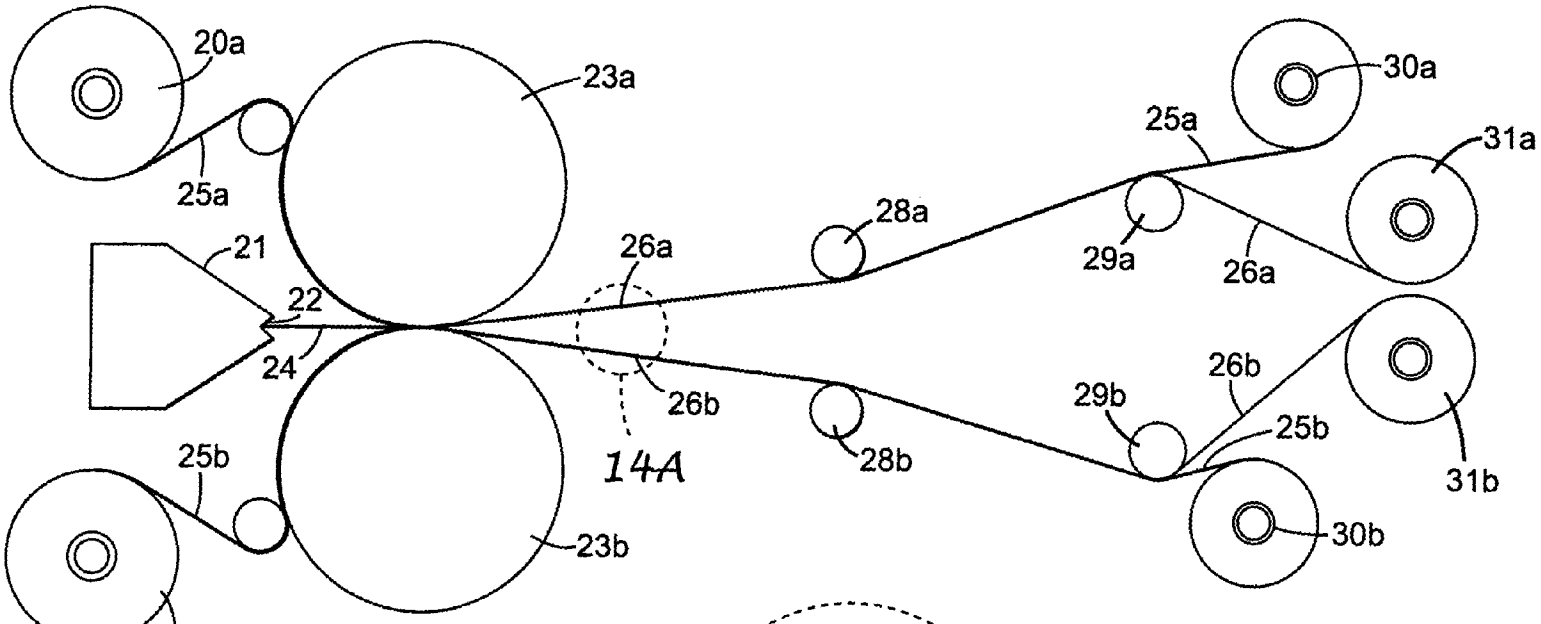
FIG. 14 depicts a simplified schematic illustration of another embodiment of a method for producing a napped polymer film according to the present invention.
Figure 14A:
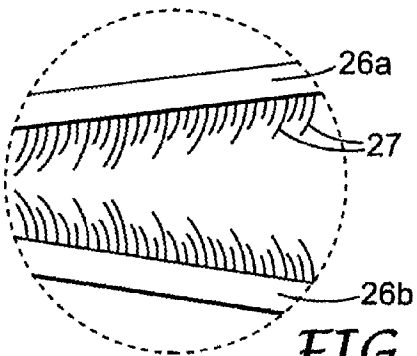

FIG. 14 illustrates one process suitable for forming angel hair microfibers. A thermoplastic polymer film 24 (e.g., a polyethylene film) exits the film die 22 of the extruder in a softened state and is laminated to two carrier films 25*a*, 25*b* in a nip between chill rolls 23*a*, 23*b*. The temperatures of the polymer film 24 exiting the extruder and the chill rolls 23*a*, 23*b* is adjusted so that the polymer film 24 is still in a softened state as it exits the nip. The two carrier films are separated by means of rollers 29*a* and 29*b* as they exit the nip. This causes the softened polymer film to be split into two films. During the separation, the softened center portion of the polymer film is pulled and drawn out into a plurality of high aspect ratio microfibers. The forming microfibers cool to a point where the polymer material solidifies. Further separation of the carrier films 25*a*, 25*b* then causes the microfibers to break, thereby generating two unitary napped films 26*a*, 26*b* each having a plurality of projecting high aspect ratio microfibers. If desired, the carrier films 25*a*, 25*b* can be delaminated from the back of the napped polymer films 26*a*, 26*b* and rolled up onto respective pick up rolls 30*a* and 30*b*.

Figure 15:
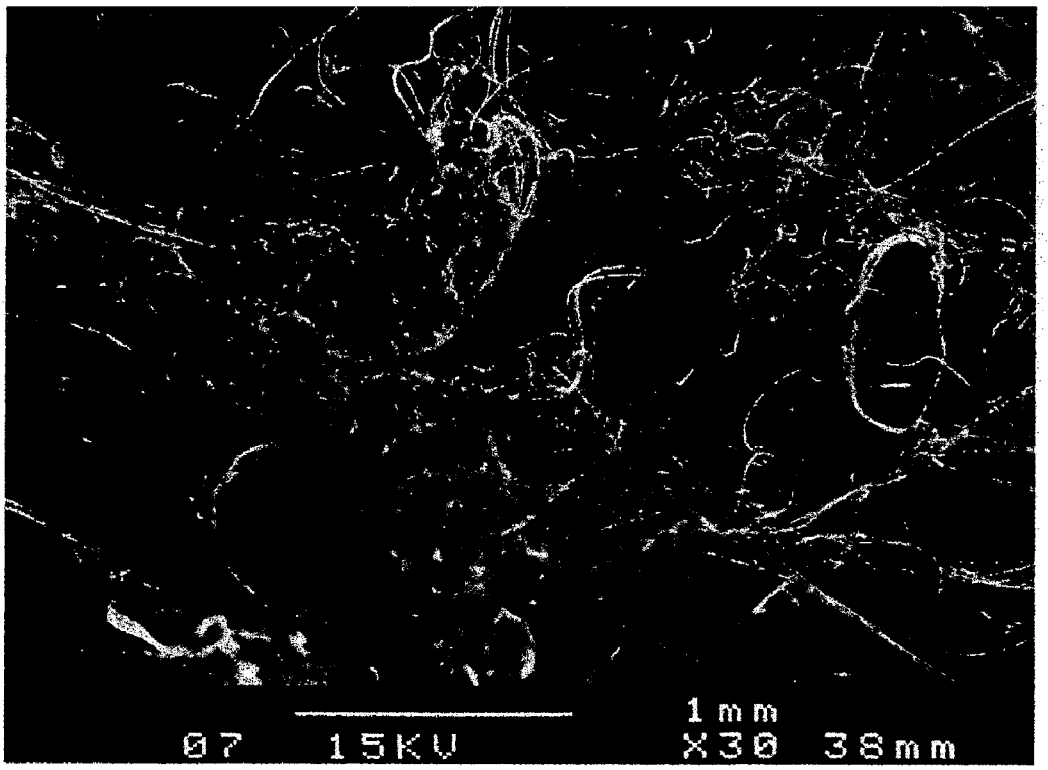
FIG. 15 shows an electron micrograph (30×magnification) of a napped polymer film produced according to the method depicted in FIG. 14.

FIG. 15 shows an electron micrograph of an exemplary angel hair napped film as described herein. As shown, the microfibers have an extremely high aspect ratio. Typically, napped polymer fibers of this type have microfibers with an aspect ratio of at least about 10. Such angel hair microfibers typically have a maximum cross-sectional dimension of at least about 10 microns, but no more than about 100 microns, and preferably about 10 to about 50 microns.

The invention is further characterized by the following examples. These examples are not meant to limit the scope of the invention as set forth in the foregoing description and variations within the concepts of the invention will be apparent.

EXAMPLE 1

A 0.16 mm thick film of linear low density polyethylene (available from CT Films, Chippewa, Wis. under the designation X0–52; XEM 352.1) was structured on one side with features that were square at their base or intersection with the film and raised to a rounded top; the square base was about 75 μm on a side and the height was about 30 μm.

Figure 2:
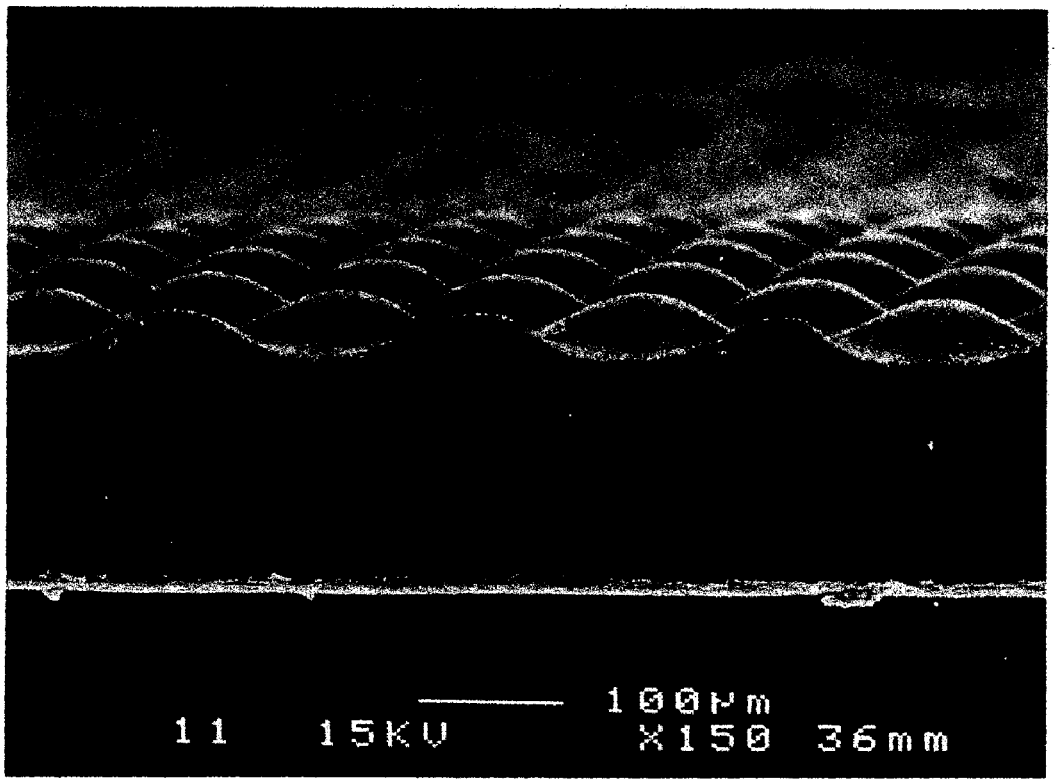
FIG. 2 shows an electron micrograph (150×magnification) of a polymer substrate surface having a plurality of microprotrusions prior to treatment according to the present method, where the surface is viewed from an angle of about 5° above the plane of the surface.
Figure 3:
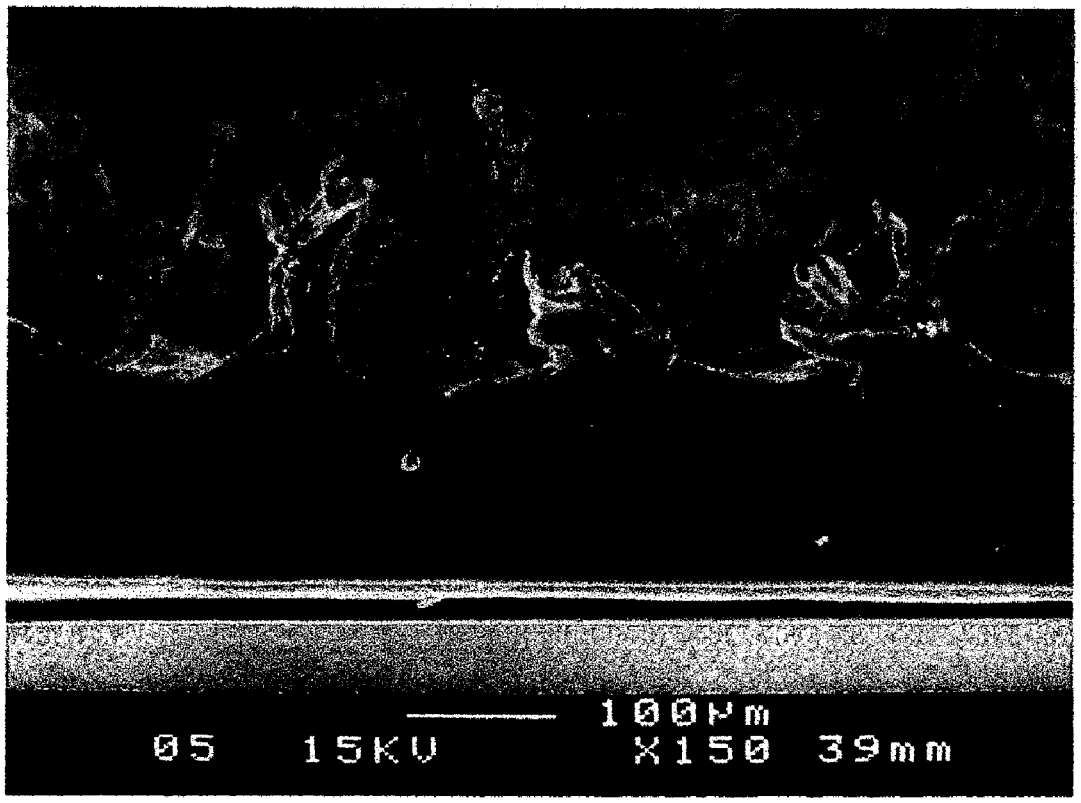
FIG. 3 shows an electron micrograph (150×magnification) of the surface of the polymer substrate of FIG. 2 after reciprocating contact with an 80 grit coated abrasive surface according to the present method.

The placement of the features formed a square lattice array about 0.12 mm on a side (see FIG. 2). The structured side of this film was treated with a random orbit palm sander (DeWalt Model DW 421) using 80 grit coated abrasive (80A NO-FIL ADALOX A273 available from Norton, Troy, N.Y.). Moderate hand pressure was used on the sander as it was slowly moved back and forth in a reciprocating motion in one direction for about 15 sec and then back and forth in a second direction perpendicular to the first for another 15 sec. A section was cut from the center of this sample and examined with a scanning electron microscope. Fibers with frayed tips were formed predominately at each of the raised features and extended to various heights up to about 200 μm (FIG. 3).

EXAMPLE 2

Figure 4:
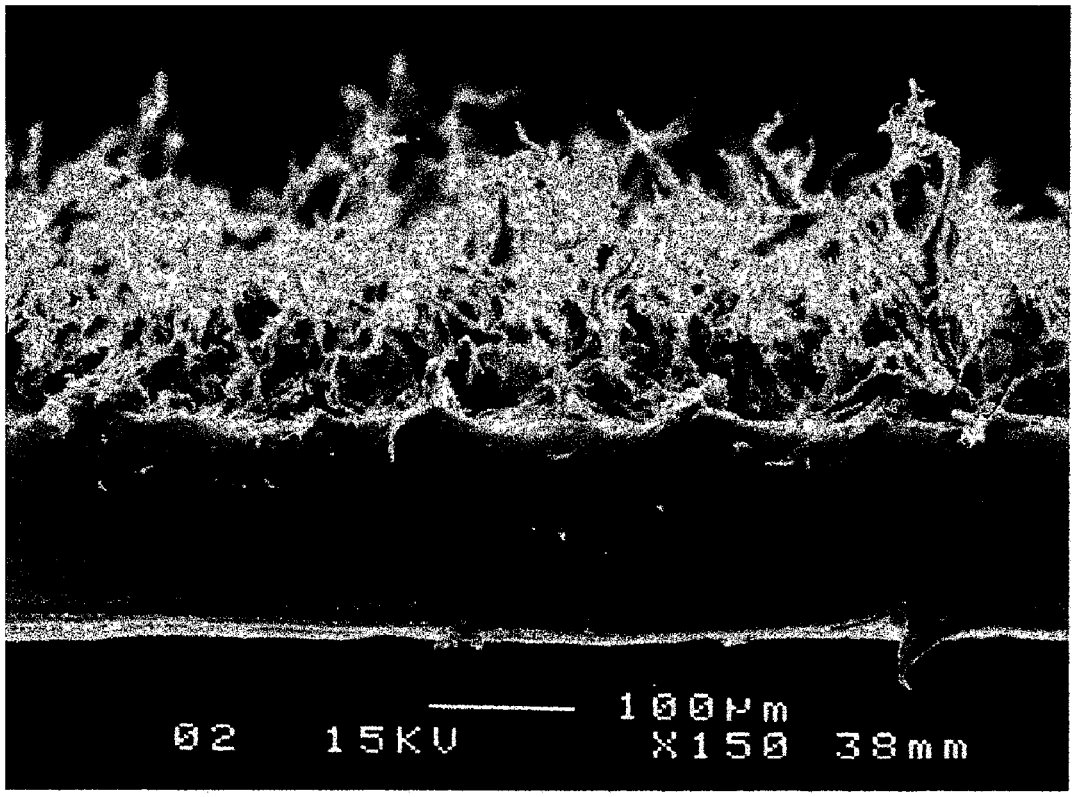
FIG. 4 shows an electron micrograph (150×magnification) of the surface of the polymer substrate of FIG. 2 after reciprocating contact with an 180 grit coated abrasive surface according to the present method.

The XEM 352.1 low density polyethylene was treated as described Example 1 except that a 180 grit coated abrasive was used (P180 255L PRODUCTION RESIN BONDED FRE-CUT FILM OPEN COAT, 3M, St. Paul, Minn.). An electron micrograph of material prepared as per this example is shown in FIG. 4. The fibers formed predominately at the raised features, had lengths up to about 250 μm, were frayed at the ends and were smaller in cross section than fibers formed with the coarser grit in Example 1.

EXAMPLE 3

Figure 5:
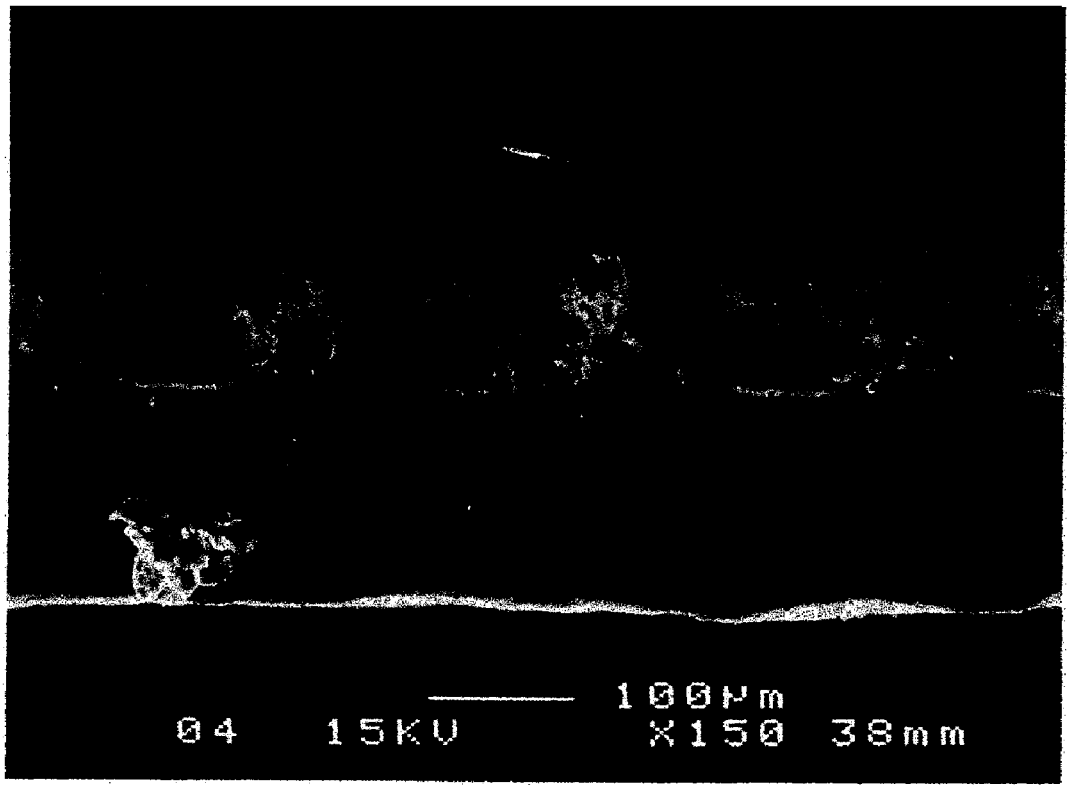
FIG. 5 shows an electron micrograph (150×magnification) of the surface of the polymer substrate of FIG. 2 after reciprocating contact with an 400 grit coated abrasive surface according to the present method.

The XEM 352.1 low density polyethylene was treated as described Example 1 except that a 400 grit coated abrasive was used (P400 SG3 PRODUCTION RESIN BONDED FRE-CUT FILM OPEN COAT, 3M, St. Paul, Minn.). An electron micrograph of material prepared as per this example is shown in FIG. 5. The fibers formed at the raised features, had lengths up to about 100 μm, were frayed at the ends and were smaller in cross section than fibers formed with the coarser grits in Examples 1 and 2.

EXAMPLE 4

Figure 6:
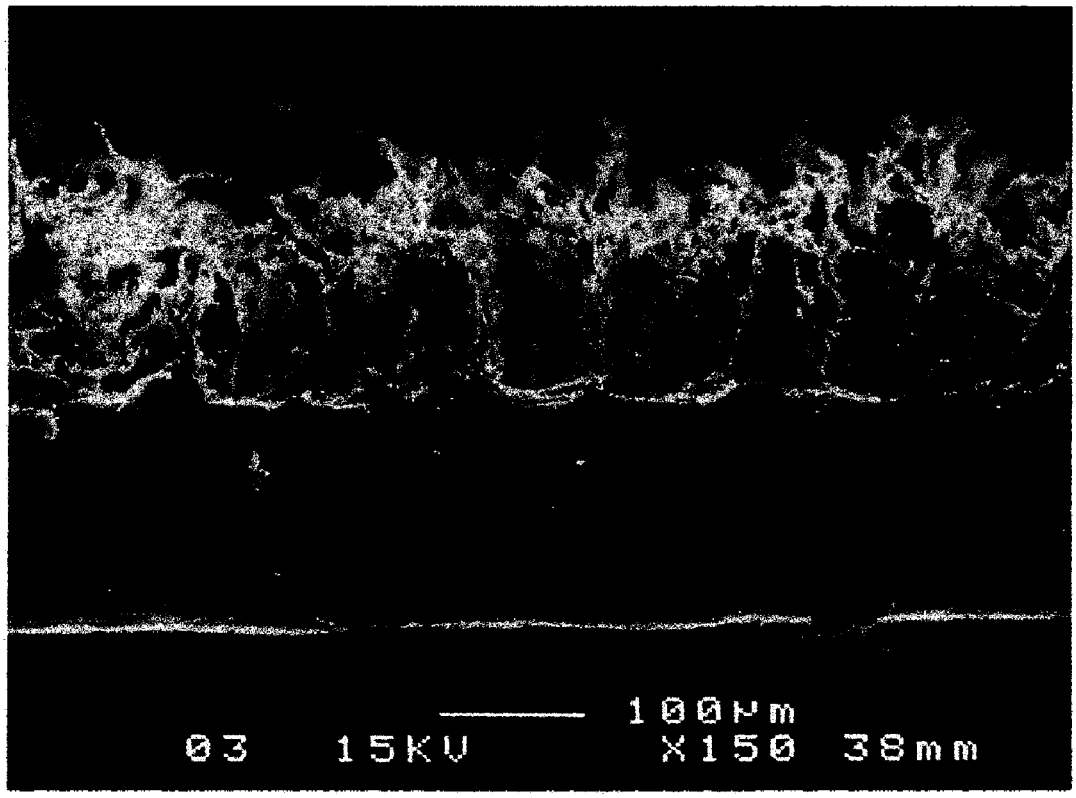
FIG. 6 shows an electron micrograph (150×magnification) of the surface of the polymer substrate of FIG. 2 after successive reciprocating contact with 80 grit and 400 grit coated abrasive surfaces according to the present method.

The napped polymer sheet produced in Example 1 was further treated by the same procedure using a finer grit abrasive, i.e., after abrading the structural polyethylene surface with 80 grit coated abrasive, as described in Example 1, the resulting napped surface was subsequently treated with 400 grit paper. This double treatment, i.e., abrasion with two different coated abrasives with the second much finer in size than the first, further frayed the ends of the fibers (FIG. 6) and generated microfibrils extending from the microfibers produced with the coarse (80 grit) treatment.

EXAMPLE 5

A poly(vinyl chloride) film (PVC) was formed by spraying the mixture shown below on a nickel plate and allowing the solvents to evaporate. Two coats of the PVC containing mixture were typically applied to produce a 0.16 mm thick film after evaporation of the solvents.

| Material | Percentage |
|---|---|
| Silicone | 0.00056 |
| Toluene | 59.63 |
| PVC Resin | 15.15 |

-continued

| Material | Percentage |
|---|---|
| Sudan Red | 0.02 |
| n-Butyl Acetate | 3.94 |
| Methyl Isobutyl Ketone (MIBK) | 15.93 |
| Paraplex G-40 | 2.53 |
| Dibutyl Ethyl Phthalate | 2.53 |
| Stabilizer SN | 0.211 |

The silicone fluid (40 cps, available from General Electric, Fairfield, Conn. under the designation SF-69) was dissolved in 0.4% of the toluene and the remaining toluene charged into a mixer. The silicone solution was added to the toluene in the mixer with agitation, followed by a slow addition of the PVC resin (vinyl chloride/vinyl acetate copolymer resin—14% vinyl acetate—BYHH-1 UCAR available from Union Carbide, Danbury, Conn.) and the resulting mixture agitated for 20 minutes. Sudan Red (red dye 380 Sudan available from BASF, Mount Olive, N.J.), n-butyl acetate, and MIBK were added and the mixture was agitated for an additional 15 minutes. The mixture was heated to between 35° C. and 43° C., the heat source removed, and agitation continued for an additional 30 minutes. Paraplex G-40 (a plasticizer available from C. P. Hall, Bedford Park, Ill.) and dibutoxy ethyl phthalate plasticizer (200 Plasthol available from C. P. Hall, Bedford Park, Ill.) were then slowly added to the mixture, with agitation. Stabilizer/antioxidant (Interstab SN-MO, available from Akzo America, Inc. Interstab Chemicals Division, New Brunswick, N.J.) was added and the mixture agitated until a clear solution was obtained (approximately 20 minutes). The resulting solution was filtered through a 10 μm filter before use.

A sandwich construction consisting of the above 0.16 mm thick PVC film, a 0.13 mm thick polyethylene (PE) film, and a flat nickel plate was heated to 177° C. on a hot plate. A sheet of closed celled, polyurethane foam prepared generally as described in U.S. Pat. No. 3,772,224 (Marlin et al.) and U.S. Pat. No. 3,849,156, (Marlin et al), which are incorporated herein by reference was prepared as follows:

A 3.2 mm thick layer of polyurethane foam was prepared from a four part mix (A–D), the composition of which were:

Part A—100 parts of a polyol mixture of consisting of Niax 24–32 (97.77 parts) and Niax E-434 (2.23 parts), polyether polyols (available from Arco Chemical Co., Newton Square, Pa.) dipropylene glycol (9.18 parts per hundred parts polyol (php); fragrance grade), Niax LC-5615 (3.74 php, a nickel catalyst composition available from OSI Specialties, Lisle Ill.), aluminum trihydrate filler (54.59 php, Aloca C-331, available from Aluminum Company of America, Bauxite, Ark.), and Hostaflam AP 442 flame retardant (16.38 php, available from Hoescht Celanese Corp., Charlotte, N.C.);

Part B—37.39 php of an isocyanate mixture consisting of 4,4'-diphenylmethane diisocyanate and a modified 4,4'-diphenylmethane diisocyanate (Rubinate 1920 available from ICI, Rubicon Chemicals, Geismer, La.);

Part C—4.77 php of a 70.9% (w/w) solution of a silicone surfactant (L-5614, available from OSI Specialties) in a polyether glycol (Niax E-351, available from Arco Chemical Co.); and Part D—6.71 php of an approximately 8% solids (w/w) dispersion of carbon black (Product No. 1607029, available from Spectrum Colors, Minneapolis, Minn.) in polyether glycol (Niax E-351).

Separate feed streams of the four parts were pumped into a 90 mm dual head Oakes Frother (available from ET Oakes Corp., Hauppauge, N.Y.) through an entrance manifold attached to the frother. The mixture was frothed by injecting high purity nitrogen through a capillary tube located at the entrance to the frother. The frothed mixture was processed through the frother at a mixing speed of 800 rpm and a discharge pressure of about 0.55 Mpa and dispensed from an approximately 2.6 m×1.3 cm hose onto a polyester film and spread over the film using a knife coater (2.4 mm gap). The foam was cured by passage through a 3 chambered 13.7 m forced air oven at a line speed of 1.5–1.8 m/minute. The first chamber was maintained at 135° C. The second and third chambers were maintained at 154° C.

The above described foam was heat laminated to the PVC-PE-metal construction, the entire laminate cooled, and delaminated; with separation occurring at the PVC-PE interface. During lamination, the PVC film flowed, filling the smaller pores of the polyurethane foam and forming bubbles in the larger pores; which subsequently filled with PE. During delamination, the PE was elongated to form fibers at each of these sites. In some cases, lamination forced the PVC and PE deeper into the foam (by interconnecting pores) which produced fibers having expanded portions along their length on delamination of the sandwich construction.

EXAMPLE 6

A 50 μm thick film of polyethylene terephthalate (PET) was knife coated (gap between bar and film of 0.645 mm) with hot melt adhesive (F-10, a 40% solids acryloid resin based adhesive available from Rohm Haas, Philadelphia, Pa.). The dried adhesive thickness was about 5 μm. The coated film was heated to 70° C. to tackify the adhesive and the adhesive was then flood coated with an excess of glass beads of substantially uniform diameter (about 50 μm). After cooling to room temperature, excess beads were removed to leave a monolayer of beads attached to the adhesive. The sample was again heated to 70° C. for about 15 min. to heat sink the glass beads in the adhesive, i.e., the beads were touching the adhesive-PET interface. After cooling to room temperature, the sample was coated with RTV silicone rubber (Silastic "J", Dow Corning, Midland, Mich.) using a knife coater set at gap of 0.5 mm between the bar and the base of the coater. Prior to curing the silicone rubber, the sample was placed in a vacuum chamber to remove entrapped air. After curing, the silicone rubber was separated from the F-10 coated PET and the glass beads removed from the silicone rubber by stretching the rubber and shaking out the beads.

Figure 8:
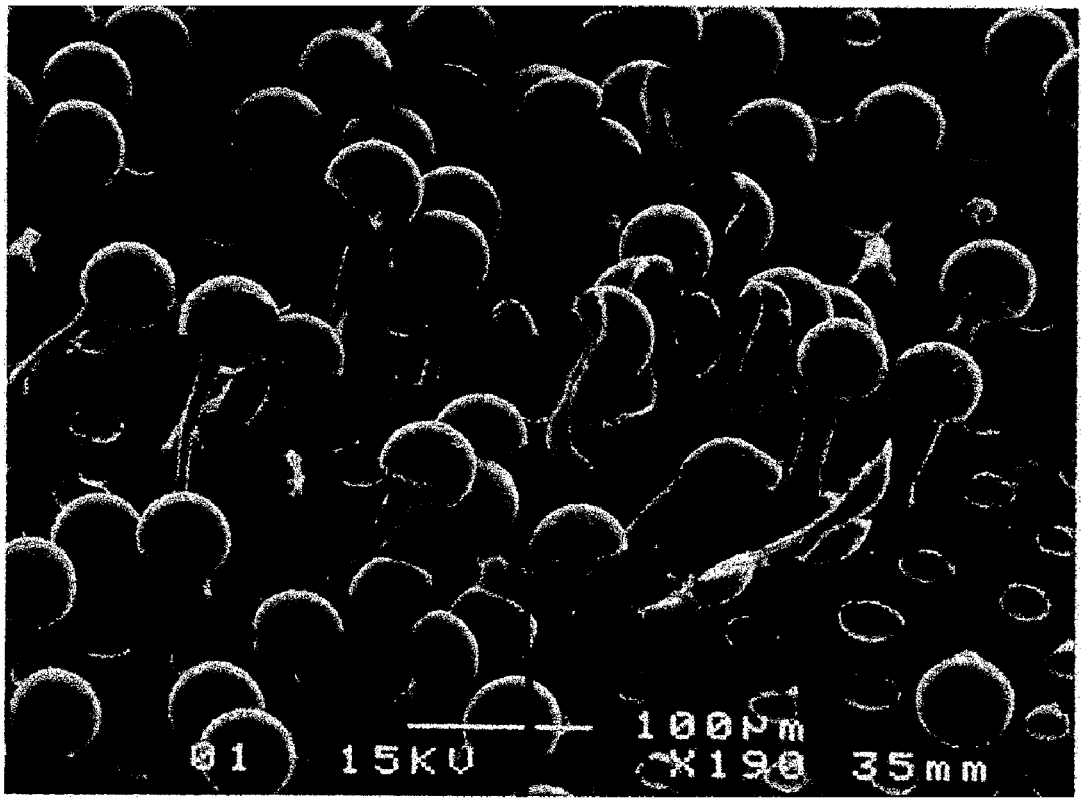
FIG. 8 shows an electron micrograph (190×magnification) of a cross sectional view of a portion of a napped polymer substrate having a plurality of expanded head microfibers.
Figure 9:
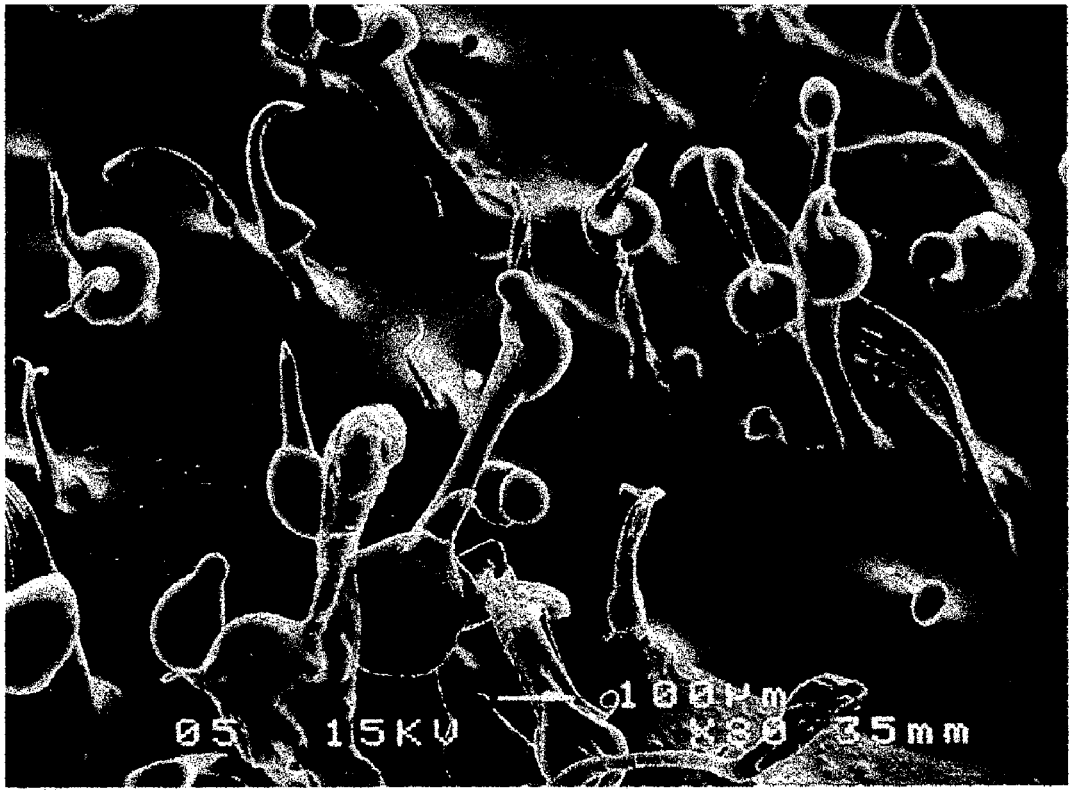
FIG. 9 shows an electron micrograph (190×magnification) of a cross sectional view of a portion of a napped polymer substrate having a plurality of expanded cross-section microfibers.

A 50 μm thick KAPTON film (a polyimide film available from E.I. duPont de Nemours and Company, Inc., Wilmington, Del.) was placed on the surface of a hot plate maintained at 188° C. A 0.5 mm thick film of polypropylene was placed on the KAPTON film and allowed to melt. The silicone rubber mold was placed on the molten polypropylene and pressed into the molten polypropylene, forcing the polypropylene into the recesses of the silicone rubber mold. The laminate was removed from the hot plate and, as the sample was cooling, the silicone rubber was slowly separated from the polypropylene/KAPTON laminate, forming expanded-head microfibers on the surface the polypropylene. The microfibers had a stem of polypropylene that connected the base layer of polypropylene with a ball of polypropylene in each recess of the silicon rubber mold. This stem increased in length as the polypropylene continued to cool until the ball of polypropylene popped out of the silicon rubber. The resulting surface of the polypropylene was an array of stems with a ball of polypropylene at the top as shown in the electron micrograph of FIG. 8.

EXAMPLE 7

An embossed polypropylene film (0.2 mm thick) having a pattern of 40 μm diameter cylindrical recesses of 30 μm depth in a hexagonal array with 127 μm spacing was prepared by extruding polypropylene resin (DS7C50, available from Shell Chemical Co., Houston, Tex.) from a single screw extruder (Model DS15H, available from Davis Standard, Stamford, Conn.) equipped with a 3.8 cm diameter cylinder, into the nip of a two roll embossing apparatus. The extruder, which was operated at 254° C., delivered a 22.9 cm wide sheet of molten polypropylene through a 30.5 cm die having a 0.25 mm die gap at a rate of 55 g/m$^2$, vertically downward into the nip of the embossing apparatus which was positioned about 7.6 cm below the die. The embossing apparatus utilized two 24.5 cm diameter by 30.5 cm long steel rolls having independent temperature controls. The embossing roll was heated to 49° C. and carried the embossing pattern described above. The second was cooled to 7° C. and served as a chill roll. The polypropylene film was embossed at a nip pressure of 138 kPa and a line speed of 1.5 m/sec.

Figure 11:
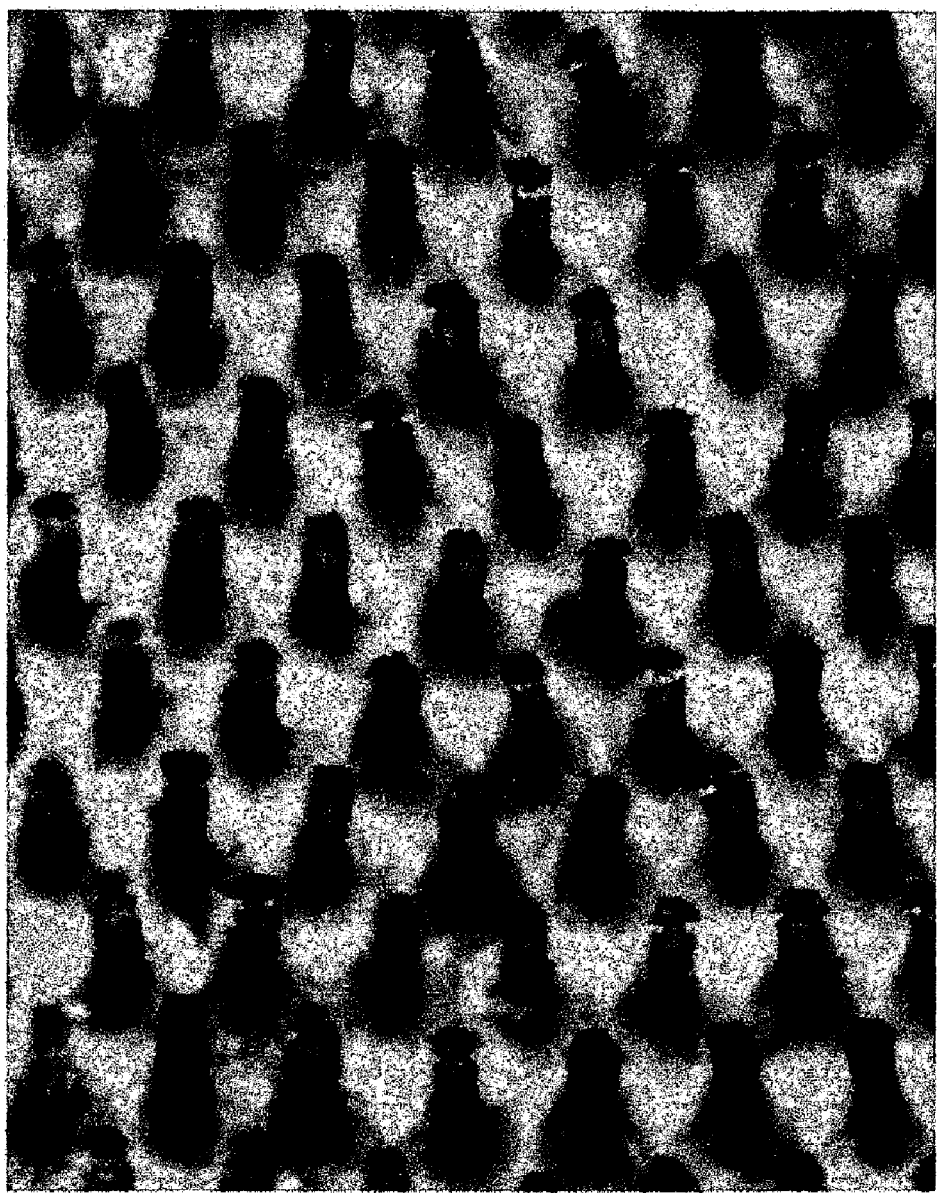
FIG. 11 shows an electron micrograph (100×magnification) of tapered microfibers on a surface of a polymer substrate produced by the method depicted in FIG. 10.

The embossed polypropylene film was cut into 25 mm wide strips, a thin layer of silicone release agent (Syl-Off 294, available from Dow Corning, Midland, Mich.) applied to the embossed side of the film such that only the flat land surface (not the recesses) was coated. A "sandwich" construction was prepared by laminating a second web consisting of 25 mm wide strips of 79 μm thick ethylene-vinyl acetate copolymer ("EVA") and 22 μm thick polyethylene terephthalate ("PET") to the release agent coated side of the polypropylene with the EVA layer against the polypropylene. Lamination was accomplished using a Risolve™ MR712 laminator (available from Western Magnum, Hermosa Beach, Calif.), processing the sandwich construction at 113° C. (roll temperature), 200 kPa pressure, and 50 cm/min. processing speed. The laminate was separated by pulling on the polypropylene and PET layers approximately 12 seconds after the laminate exited the laminator nip (EVA temperature of approximately 60° C.). On delamination the EVA film formed post-like microfibers attached to the PET/EVA web whose spacing corresponded to the spacing of the recesses in the polypropylene (see FIG. 11). A small amount of the EVA was left in the recesses in the polypropylene. The microfibers had a height (100 μm) more than three times the depth of the recesses in the polypropylene (30 μm) and a diameter of (15 μm) which was less than half the diameter of the recesses (40 μm).

EXAMPLE 8

A 600 μm thick silicone rubber screen having a square pattern of square holes 300 μm apart with 200 μm width opening on one side and 120 μm width opening on the other side was sandwiched between two sheets of EVA/PET similar to that used in Example 7 with the EVA layers against the silicone rubber screen. The sandwich was laminated together using a hot press operating at a temperature of 120° C. and approximately 138 kPa pressure for 10 seconds. Under these conditions the separate EVA layers flowed together through the holes in the screen, entrapping the screen. The sample was cooled to 60° C. and the PET layers were immediately pulled apart. The EVA which had filled the holes of the silicone rubber screen elongated into tapered columns typically about 900 μm long and 200 μm wide on the base end and 60 μm wide at the tip end. The columns broke close to their narrow outer tips during delamination of the layers allowing the screen to be removed.

EXAMPLE 9

A multilayer film (25 μm of polypropylene/12 μm of low density polyethylene/75 μm of polyester/12 μm of low density polyethylene/25 μm of polypropylene (available from Schoeller Technical Papers, Inc., Pulaski, N.Y.) was sandwiched between two layers of 38 μm thick KAPTON film and placed on a 188° C. hot plate for about 10 minutes (until the polyolefin components of the film had completely melted). The laminate was then removed from the hot plate and the two layers of KAPTON film were pulled apart while concurrently pulling the middle layer of polyester straight out of the laminate. The outer polypropylene layers adhered to the KAPTON film and the polyethylene layers formed microfibers of different lengths as the material cooled. This produced two films each consisting of a flat layer of polypropylene with a network of high aspect ratio polyethylene microfibers extending from the surface of the polyethylene coated polypropylene.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

What is claimed is:

1. A method of producing a unitary polymer substrate having a napped surface, said method comprising:

providing a template surface comprising a release material and having a plurality of microdepressions therein, said microdepressions have a non-release surface therein;

laminating a thermoplastic polymer substrate to the template surface such that a portion of the thermoplastic polymer enters into the plurality of microdepressions; and delaminating the thermoplastic polymer substrate from the template surface while maintaining a surface of the thermoplastic polymer substrate in a sufficiently softened state such that a plurality of microfibers are generated on the thermoplastic polymer surface prior to debonding of the thermoplastic polymer substrate from the template surface.

2. The method of claim 1, wherein the providing step comprises providing a template surface comprising a release material and having a plurality of microdepressions therein, said microdepressions have a non-release surface therein, wherein the non-release surface is located on a bottom portion of the microdepressions.

3. The method of claim 2, wherein the providing step comprises providing a template surface comprising a polyolefin film having a plurality of microdepressions embossed therein and overcoated with a release material such that the bottom portion of the microdepressions and an outer surface of the polyolefin film comprise the release material.

4. The method of claim 3, wherein the polyolefin film comprises a polypropylene film, and the release material comprises a silicone release material.

5. A method of producing a unitary polymer substrate having a napped surface comprising:

providing a template surface comprising a release material and having a plurality of microdepressions therein;

laminating a surface of a thermoplastic polymer substrate to the template surface such that a portion of the thermoplastic polymer enters into the plurality of microdepressions; and delaminating the thermoplastic polymer surface from the template surface while maintaining the thermoplastic polymer surface in a sufficiently softened state such that a plurality of microfibers are generated on the thermoplastic polymer surface prior to debonding of the thermoplastic polymer surface from the template surface; wherein the providing step comprises providing a template surface comprising a release material and having a plurality of microdepressions therein, wherein the microdepressions have a non-release surface therein, the laminating step comprises laminating the polymer substrate to the template surface to form microprojections on the polymer substrate, each microprojection being bonded to one of the microdepression non-release surfaces; and the delaminating step comprises delaminating the polymer substrate from the template surface while maintaining the polymer substrate in a sufficiently softened state such that the microprojections are stretched into microfibers before debonding from the non-release surfaces.

6. The method of claim 5 wherein the microfibers have an average maximum cross-sectional dimension of about 25 to about 200 microns.

7. The method of claim 5 wherein the microfibers have an average length of about 50 to about 500 microns.

8. The method of claim 5 wherein the microfibers have a tapered cross-section.

9. The method of claim 8 wherein the microfibers have a curved profile.

10. The method of claim 5 wherein the providing step comprises providing a template surface comprising a screen laminated to a surface of a non-release substrate, the screen having an outer surface formed from a release material.

11. The method of claim 10 wherein the screen is formed from silicone rubber.

12. A method of producing a unitary polymer substrate having a napped surface comprising:

providing a resilient template surface comprising a release material and having a plurality of microdepressions therein, wherein the resilient template surface comprises a polymer foam;

laminating a surface of a thermoplastic polymer substrate to the template surface such that a portion of the thermoplastic polymer enters into the plurality of microdepressions; and delaminating the thermoplastic polymer surface from the template surface while maintaining the thermoplastic polymer surface in a sufficiently softened state such that a plurality of microfibers are generated on the thermoplastic polymer surface prior to debonding of the thermoplastic polymer surface from the template surface.

13. The method of claim 12 wherein the microfibers have an average length of about 50 to about 500 microns.

14. The method of claim 13 wherein the microdepressions have an average depth of no more than about 40% of the average microfiber length.

15. The method of claim 12 wherein, the providing step comprises providing a resilient template surface comprising a release material and having a plurality of undercut-shaped microdepressions therein;

the laminating step comprises laminating the polymer surface to the resilient template surface such that a portion of the thermoplastic polymer enters into the plurality of undercut-shaped microdepressions; and the delaminating step comprises delaminating the polymer surface from the resilient surface while maintaining the polymer surface in a sufficiently softened state to generate a plurality of expanded-cross section shaped microfibers projecting from the polymer surface.

16. A method of producing a unitary polymer substrate having a napped surface, said method comprising:

providing a resilient template surface having a plurality of undercut-shaped microdepressions therein, the resilient template surface comprising an open cell foam;

laminating a thermoplastic polymer substrate to the resilient template surface such that a portion of the thermoplastic polymer enters into the plurality of undercut-shaped microdepressions; and delaminating the thermoplastic polymer substrate from the resilient template surface while maintaining a surface of the thermoplastic polymer substrate in a sufficiently softened state such that a plurality of microfibers are generated on the thermoplastic polymer surface prior to debonding of the thermoplastic polymer substrate from the resilient template surface.

17. A method of producing a unitary polymer substrate having a napped surface, said method comprising:

providing a resilient template surface having a plurality of microdepressions therein;

laminating a surface of a thermoplastic polymer substrate to the resilient template surface such that a portion of the thermoplastic polymer enters into the plurality of microdepressions; and delaminating the thermoplastic polymer surface from the resilient template surface while maintaining the thermoplastic polymer surface in a sufficiently softened state such that a plurality of microfibers are generated on the thermoplastic polymer surface prior to debonding of the thermoplastic polymer surface from the resilient template surface, wherein the providing step comprises providing a resilient template surface comprising a screen laminated to a surface of a non-release substrate, the screen having an outer surface formed from a release material.

18. The method of claim 12 wherein the polymer foam is an open cell foam.

19. The method of claim 17, wherein the microfibers have an average maximum cross-sectional dimension of about 25 to about 200 microns.

20. The method of claim 17, wherein the microfibers have an average length of about 50 to about 500 microns.

21. The method of claim 17, wherein the microfibers have a tapered cross-section.

22. The method of claim 17, wherein the microfibers have a curved profile.

23. The method of claim 17, wherein the screen is formed from a silicone rubber.

24. The method of claim 17, wherein the method results in a random placement of microfibers on the thermoplastic polymer surface of the thermoplastic polymer substrate.

* * * * *

UNITED STATES PATENT AND TRADEMARK OFFICE

CERTIFICATE OF CORRECTION

PATENT NO. : 7,070,727 B2
APPLICATION NO. : 10/600966
DATED : July 4, 2006
INVENTOR(S) : Clyde D. Calhoun It is certified that error appears in the above-identified patent and that said Letters Patent is hereby corrected as shown below:

Column 3
Line 4, delete "micofibers" and insert -- microfibers --, therefor.
Line 9, delete "micofibers" and insert -- microfibers --, therefor.

Column 4
Line 32, delete "an 400" and insert -- a 400 --, therefor.

Column 10
Line 31, delete "Coming" and insert -- Corning --, therefor.

Column 19
Line 18, in Claim 15, delete "expanded-cross section" and insert -- expanded cross-section --, therefor.

Column 20
Line 20, in Claim 18, after "claim 12" insert -- , --.

Signed and Sealed this

Fourteenth Day of November, 2006

JON W. DUDAS
*Director of the United States Patent and Trademark Office*